US005950043A

United States Patent [19]

Fujita et al.

[11] Patent Number: 5,950,043

[45] Date of Patent: Sep. 7, 1999

[54] IMAGE FORMING METHOD AND IMAGE FORMING APPARATUS FOR DETECTING A LOW LEVEL OF TONER

[75] Inventors: Toru Fujita; Yasuhito Hirashima, both of Nagano, Japan

[73] Assignee: Seiko Epson Corporation, Tokyo, Japan

[21] Appl. No.: 08/955,247

[22] Filed: Oct. 21, 1997

[30] Foreign Application Priority Data

Oct. 21, 1996 [JP] Japan ..... 8-297835

[51] Int. Cl.[6] ..... G03G 15/08

[52] U.S. Cl. ..... 399/60; 399/29; 399/49

[58] Field of Search ..... 399/27, 28, 29, 399/49, 59, 60

[56] References Cited

U.S. PATENT DOCUMENTS

| | | | |
|---|---|---|---|
| 4,277,162 | 7/1981 | Kasahara et al. | 399/49 |
| 4,963,927 | 10/1990 | Ishihara | 399/29 |
| 4,974,024 | 11/1990 | Bares et al. | 399/60 X |
| 5,204,699 | 4/1993 | Birnbaum et al. | 346/160 |
| 5,349,317 | 9/1994 | Notani et al. | 333/236 |
| 5,559,579 | 9/1996 | Gwaltney et al. | 399/59 |
| 5,649,266 | 7/1997 | Rushing | 399/59 |
| 5,787,320 | 7/1998 | Eun et al. | 399/59 |

FOREIGN PATENT DOCUMENTS

| | | | |
|---|---|---|---|
| 55-163562 | 12/1980 | Japan | G03G 15/08 |
| 58-27154 | 2/1983 | Japan | G03G 15/00 |
| 59-22067 | 2/1984 | Japan | G03G 15/08 |

*Primary Examiner*—Fred L. Braun
*Attorney, Agent, or Firm*—Sughrue, Mion, Zinn, Macpeak & Seas, PLLC

[57] ABSTRACT

A remaining amount of toner in an image forming apparatus is determined. The amount of toner remaining determines whether the image forming apparatus may be in a low toner state or a no toner state. An estimate of the amount of toner remaining is obtained by accurately estimating the amount of toner consumed. Latent patch images formed on a photoconductive member 1 by an exposure unit 3 are developed by developing device to obtain patch images. Densities of the patch images are measured by a patch sensor 22, and the contents of a weighting coefficient LUT 44 are changed. Meanwhile, the amount of toner developed, which corresponds to the changed weighting coefficient, is calculated by a development toner weight calculating unit 45 for each pixel on the basis of an exposure signal. This amount of toner developed is summed by a development toner weight summing unit 46. The amount of toner consumed is calculated as a function of the density measured by the patch sensor and the amount of toner developed.

27 Claims, 19 Drawing Sheets

FIG. 19

| | | RESULT OF DETERMINATION OF TONER LEVEL | |
|---|---|---|---|
| | | PROPER AMOUNT | TONER STATE |
| MEASURED RESULT OF PATCH DENSITY | PROPER DENSITY | PROPER STATE | LOW TONER |
| | LOW DENSITY | ABNORMALITY IN THE APPARATUS | NO TONER |

IMAGE FORMING METHOD AND IMAGE FORMING APPARATUS FOR DETECTING A LOW LEVEL OF TONER

BACKGROUND OF THE INVENTION

The present invention relates to an apparatus for forming a toner image on a recording medium by using an electrophotographic system, such as a copying machine, a printer, or facsimile equipment. In such an apparatus, toner is used for image development. To be precise, toner is consumed during development. This invention, in particular, relates to a method for detecting and determining a state that exists shortly before the toner runs out. In other words, this invention particularly relates to a method of assessing when there is a low toner state. Furthermore, this invention relates also to an assessment of when there is a no toner state (i.e., a state in which the toner is substantially used up). Also, this invention relates to a method of assessing when an image development apparatus is in an abnormal state with respect to toner. Collectively, the low toner state, the no toner state, and the abnormal state may be referred to as toner states or as toner conditions of an image forming apparatus.

An image forming apparatus is comprised of an exposure controlling means for generating a light beam corresponding to an image forming signal, a photoconductive member for forming an electrostatic latent image upon receiving the light beam, a developing means for forming a toner image by causing the electrostatic latent image to attract a toner via a development roller, and a transfer means for transferring the toner image onto a recording medium.

In such an image forming apparatus, because printing is effected by causing the toner to be attached to the recording medium, the toner is consumed by printing, so that it is necessary to manage the remaining amount of toner.

For this reason, generally, the amount of toner in a developing device is optically detected by providing the developing device with an optical window for detection, or the amount of toner is detected by providing a switching means which is operated on the basis of the quantity of the toner. With the former method, however, there is a problem in that the optical window becomes stained by the toner with the lapse of the time, making it impossible to detect the amount of toner accurately. Further, the latter method involves a problem, among others, that the arrangement of the mechanism becomes complex.

To overcome such problems, a technique has been proposed in which, as disclosed in the specification of the U.S. Pat. No. 5,204,699,the toner in a developing device is estimated by calculating and summing the amount of toner consumed for each pixel on the basis of image forming signals for forming an electrostatic latent image. Further, a technique has been proposed in which, as disclosed in Japanese Patent Application Laid-Open No. 22067/1984, a toner image for testing is formed by a developing device by effecting exposure in a predetermined shape on a photoconductive member, and the amount of toner in the developing device is estimated on the basis of the optical density of the toner image.

However, with the technique in which the amount of toner consumed is estimated by using the image forming signals as in the former case, a situation can occur in which a difference arises between an estimated value and an actual amount of consumption even with respect to an identical image signal owing to a change in the amount of toner attached due to a change in the environment and the like because of a change over time of the environmental conditions and an electrophotographic process element, and although it is determined in accordance with the estimated value that there still remains a sufficient amount of toner, the toner has been actually depleted, and a misprint is outputted.

In addition, with the latter technique in which the toner image for testing is used, the following problem is encountered. That is, although the amount of toner can be detected accurately in a state in which the toner on the surface of a development roller for constituting the developing device has been newly supplied, immediately after the suspension of a developing operation, a sufficient amount of toner is attached to the development roller irrespective of the remaining amount of toner, so that the toner image for testing is formed with a high density, possibly causing an error in the determination of the amount of toner.

SUMMARY OF THE INVENTION

The present invention has been devised in view of the above-described problems, an its object is to provide a method of forming an image which is capable of accurately detecting the state of the amount of toner which can be used in printing, i.e., a low toner state and a no toner state, by using an image forming signal and a toner testing image without requiring a toner detecting means to be installed or built in a developing device.

A second object of the present invention is to provide an image forming apparatus suitable for implementing the above-described method.

Still another object of the present invention is to provide a method for detecting an abnormality of the apparatus on the basis of an estimated value of a remaining amount of toner based on an image forming signal and an estimated value of toner based on an inspected toner image.

Namely, to attain the above objects, in accordance with the present invention there is provided a method of forming an image using an image forming apparatus provided with a photoconductive in member for forming an electrostatic latent image upon receipt of a light beam generated by an image forming signal, developing means for forming a toner image by attracting a toner to the electrostatic latent image via a development roller, and transfer means for transferring the toner image to a recording medium, comprising the steps of: estimating as a toner_amount estimating step an amount of toner consumed by said developing means by calculating an amount of toner consumed by each pixel on the basis of the image forming signal; forming a toner testing image on said photoconductive member; detecting as a toner_amount detecting step the amount of toner consumed by said developing means on the basis of an optical density of the toner testing image prior to the transfer to the recording medium; and determining the amount of toner consumed by said developing means on the basis of the toner_amount estimating step and the toner_amount detecting step.

An estimated value of the amount of toner consumed, which is based on an image forming signal, is verified by the amount of toner detected by the optical density of the inspecting toner image, with the result that it is possible to prevent such a situation in which useless replenishment of toner is sought and a situation leading to the depletion of toner.

BRIEF DESCRIPTION OF THE DRAWINGS

FIG. 19 is a schematic diagram of a means for storing determination data of an apparatus state determining device in the aforementioned apparatus.

DETAILED DESCRIPTION OF A PREFERRED EMBODIMENT

Accordingly, a description will be given hereafter of an embodiment of the present invention.

Figure 1:
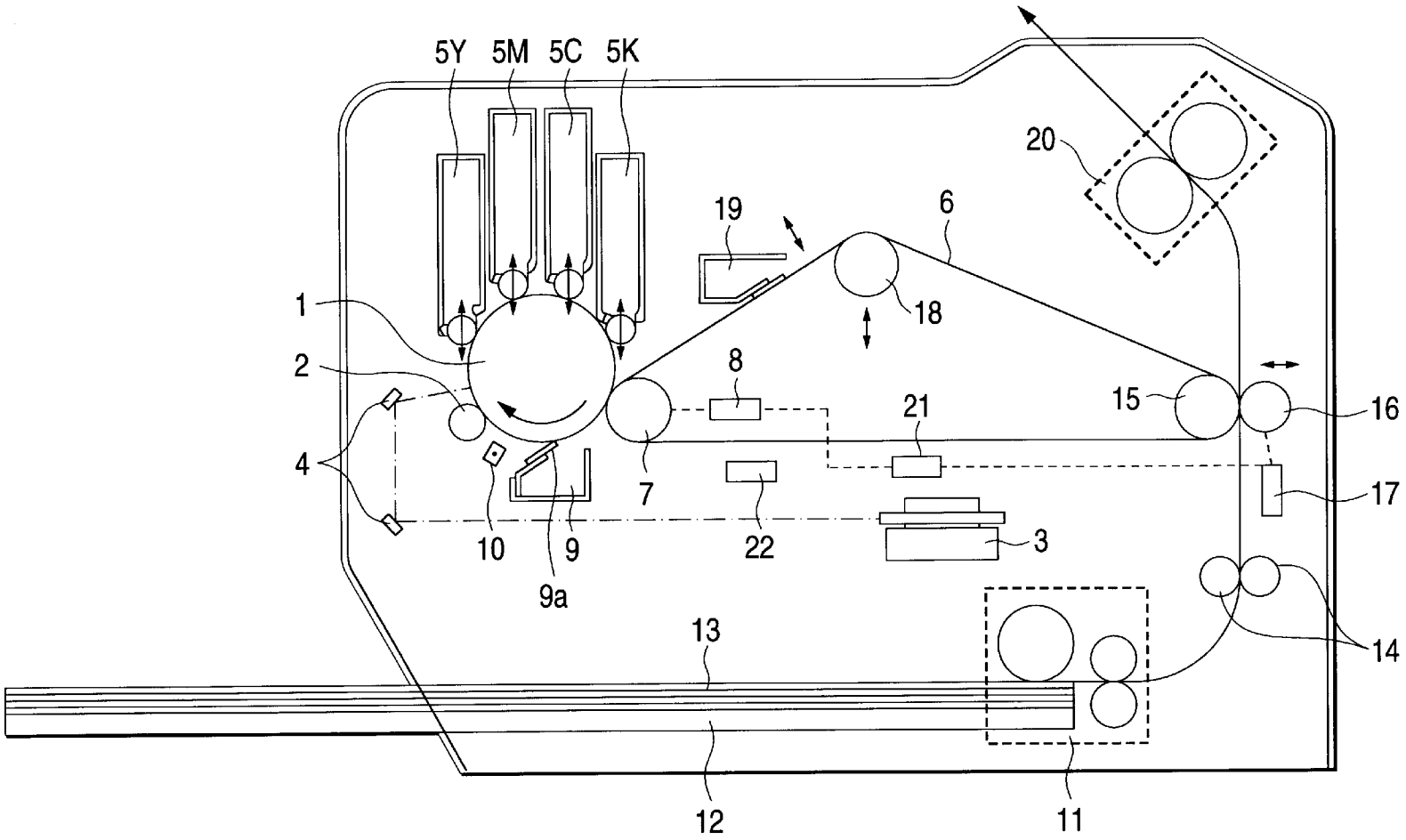
FIG. 1 is a diagram illustrating an embodiment of an image forming apparatus in accordance with the present invention.

FIG. 1 shows an embodiment of an image forming apparatus in accordance with the present invention, and is a cross-sectional view illustrating essential portions of an electrophotographic process section of a printer. In the drawing, reference numeral 1 denotes a photoconductive member which is uniformly charged to a potential suitable for forming a toner image by a charging roller 2 The arrangement provided is such that a laser beam of a predetermined resolution, e.g., 600 dpi, which has been formed by an exposure unit 3, is guided to the surface of the photoconductive member 1 by return mirrors 4 so as to allow an electrostatic latent image to be formed thereon.

Disposed around the photoconductive member 1 is a developing device 5 which is comprised of a yellow (Y) developing unit 5Y, a magenta (M) developing unit 5M, a cyan (C) developing unit 5C, and a black (K) developing unit 5K which are each arranged as a single component contact system capable of coming into contact with and moving away from the periphery of the photoconductive member 1 in the direction of the arrows in the drawing. If, for instance, one developing unit 5Y is brought into contact with the photoconductive member 1,the other developing units 5M, 5C, 5K are moved away from the photoconductive member 1,and reversal development is effected by the negatively chargeable (Y) toner by the action of an electric field due to an unillustrated power supply, thereby making the latent image on the photoconductive member 1 visible.

An intermediate transfer member 6 is arranged as an endless belt which is formed by allowing carbon to be dispersed in an ethylene-tetrafluoroethylene copolymer (ETFE) to adjust electrical resistance to an appropriate level. The intermediate transfer member 6 is supported by a primary transfer roller 7 and drive rollers 15 and 18,which will be described later, and is brought into contact with the photoconductive member 1 by the primary transfer roller 7. A bias voltage of an opposite polarity to that of the toner is applied to the primary transfer roller 7 by a power supply 8 for primary transfer, and the Y toner image on the photoconductive member 1 is transferred to the intermediate transfer member 6 on the basis of the potential difference between the primary transfer roller 7 and the photoconductive member 1.

A photoconductive member cleaner 9 is disposed in such a manner as to cause its blade 9*a* to come into contact with the photoconductive member 1 on the downstream side of the primary transfer roller 7 so as to collect the toner remaining on the photoconductive member 1 after the transfer. Further, a discharging lamp 10 for resetting the potential at the photoconductive member 1 is disposed on the downstream side of the photoconductive member cleaner 9.

The positions of the developing unit 5Y, the developing unit 5M, the developing unit 5C, and the developing unit 5K are adjusted in such a manner that the position of the intermediate transfer member 6 and the light emitting timing of the exposure unit 3 can be synchronized when these developing units are selectively brought #7 into contact with the photoconductive member 1. The arrangement provided is such that the toners of the respective colors for the same pixels are superposed on the intermediate transfer member 6 in order to form a full-color image.

Meanwhile, a recording medium 13,such as paper and an OHP sheet, is transported from a paper feeding cassette 12 to a pair of resist rollers 14 via a paper feeder 11,and is further transported to a secondary transfer section which is comprised of the drive roller 15 and a secondary transfer roller 16 capable of moving toward and away from the drive roller 15 in the direction of the arrows in the drawing so as to synchronize with the full-color toner image on the intermediate transfer member 6.

The arrangement provided is such that this secondary transfer section forms a nipping portion to allow the secondary transfer roller 16 to come into contact with the intermediate transfer member 6 in synchronism with the recording medium 13,presses the recording medium 13 in this nipping portion, causes a calculating unit 21 to calculate a voltage level suitable for transfer on the basis of the voltage from the power supply 8 for primary transfer, and controls the voltage of a power supply 17 for secondary transfer on the basis of this voltage so as to form a full-color toner image on the recording medium 13 by the action of an electric field. The recording paper 13 with the toner image formed thereon is sent to a fixing unit 20,where the toner image is fixed, and the recording paper 13 is then discharged outside the apparatus.

In the drawing, reference numeral 22 denotes a patch sensor (formed as an optical sensor combining a light emitting diode (LED) and a photosensor) adapted to detect the densities of patches formed on the intermediate transfer member 6 and which will be described later. The patch sensor 22 is disposed downstream of the primary transfer roller 7 at a position opposing the surface of the intermediate transfer member 6. The patch sensor 22 reads the densities of patch images formed on the surface of the intermediate transfer member 6,and outputs density readings (also referred to as density read signals) to an A/D converter 34 (shown in FIG. 3) Patch images may be referred also as toner testing images.

Figure 2:
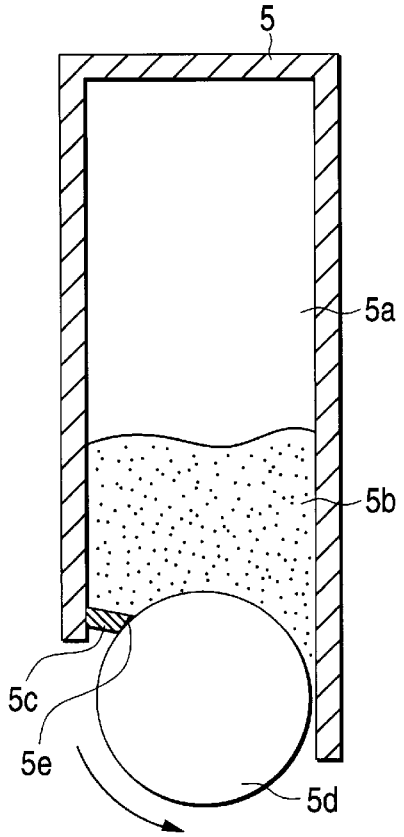
FIG. 2 is a cross-sectional view illustrating an example of a developing device used in the aforementioned apparatus.

FIG. 2 shows an example of the developing device used in the present invention. This developing device 5 is comprised of a toner chamber 5*a*, a restricting blade 5*c*, a development roller 5*d*, and a single component type toner 5*b* being stored in the toner chamber 5*a*. This toner 5*b* is provided in the toner chamber 5*a*, and is fed to a pressure contact portion 5*e* between the restricting blade 5*c* and the development roller 5*d* by means of the development roller 5*d* which is rotatively driven by an unillustrated drive motor during development, thus allowing a thin layer of toner to be formed on the development roller 5*d*.

The thin layer of toner formed on the development roller 5*d* is attracted by coming into contact with the electrostatic latent image formed on the photoconductive member 1,and develops the electrostatic latent image on the photoconductive member 1. The region of the development roller 5*d* where the toner was consumed by development receives a new supply of toner by coming into contact with the toner 5*b* stored in the toner chamber 5*a*. Meanwhile, the remaining toner which did not come into contact with the latent image on the development roller 5*d* is returned to the interior of the toner chamber 5*a* in conjunction with the rotation of the development roller 5*d*, moves within the toner chamber 5*a* while undergoing friction with the toner in the toner chamber 5*a*, is further subjected to friction with the restricting blade 5*c*, and is thereby charged to a fixed potential.

In addition, this development device 5 is preferably arranged to be of a replaceable type, so that when the toner 5*b* in the toner chamber 5*a* is depleted, the developing device 5 can be easily replaced with a new one by the user.

Although, in this embodiment, an example has been shown in which the developing device itself is replaced upon depletion of the toner, an arrangement may be provided such that a toner container is provided outside the developing device, and the toner is replenished to the interior of the developing device by replacing this container. Further, an arrangement may be provided such that the developing device is arranged as a cartridge in which the developing device is formed integrally with the photoconductive member and the like, and these members may be replaced as one set.

Figure 3:
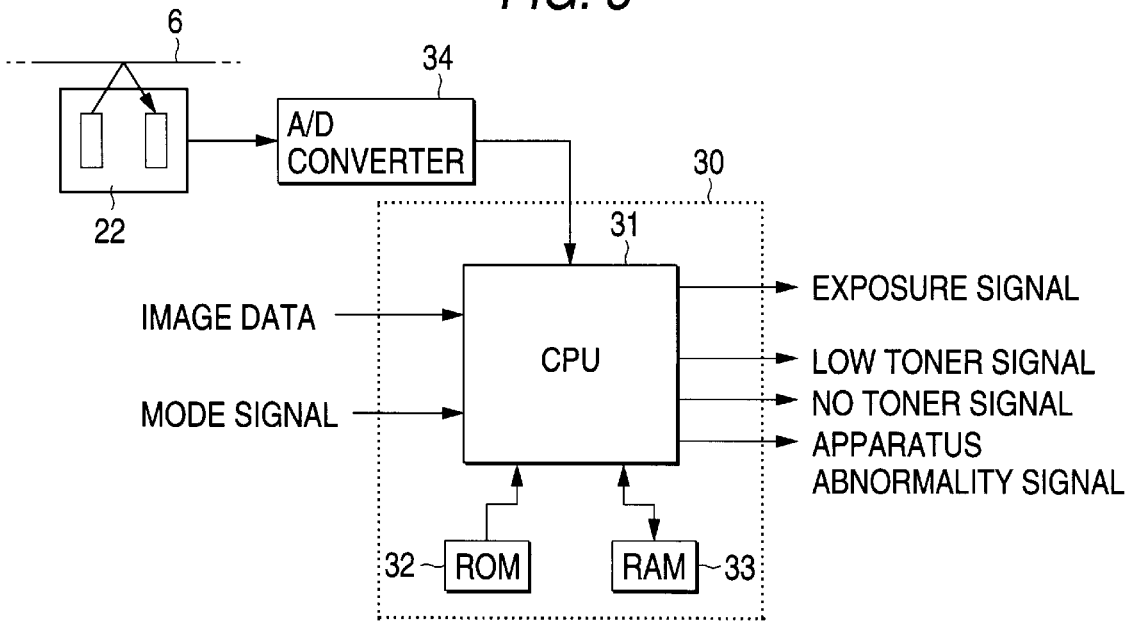
FIG. 3 is a block diagram illustrating an example of an exposure_signal generating device of a control system in the aforementioned apparatus.

FIG. 3 shows an example of a controlling device of an image forming apparatus in accordance with the present invention. The controlling device is a device which mainly effects control of the image forming operation and for generating an exposure signal on the basis of the image data. Hereafter, a description will be given of the controlling device; the description mainly concerns the generation of an exposure signal.

An exposure signal generating device may be formed as a microcomputer 30 which is comprised of a CPU 31, a ROM 32, and a RAM 33. Thus, microcomputer 30 is an example of a means for generating an exposure signal. Inputted to this exposure signal generating device are the image data, a mode signal (for selecting either one of a normal image forming mode and a patch generating mode), and a digital signal (which may be referred to as a patch sensor detection signal and may be obtained by converting an analog signal from the patch sensor 22 by the A/D converter 34). The exposure signal generating device outputs an exposure signal for the exposure unit 3, as well as a low toner signal, a no toner signal, and a signal indicating an abnormality of the apparatus, which will be described later.

In the normal image forming mode, the microcomputer 30 transforms print data sent thereto from a host, such as a personal computer, into image data by subjecting the print data to color transformation processing and_γ-transformation processing, and this image data is outputted after being transformed into an exposure signal on the basis of a lookup table (LUT) prepared in the RAM 33.

In the patch generating mode, predetermined patch images are formed on the basis of data prepared in advance in the ROM 32, and their patch densities are measured by the patch sensor 22. The data prepared in advance in ROM 32 may be referred to as predetermined patch data. In particular, the microcomputer 30 sets image forming conditions by changing the contents of the LUT stored in the RAM 33 on the basis of detection signals inputted thereto from the patch sensor 22 via the A/D converter 34. In addition to the LUT for determining the exposure data, the image forming conditions which are changed by the results of measurement of the patch densities can include parameters of the electrophotographic process such as a charging bias, a development bias, a development roller rotating speed, and a transfer bias.

Figure 4:
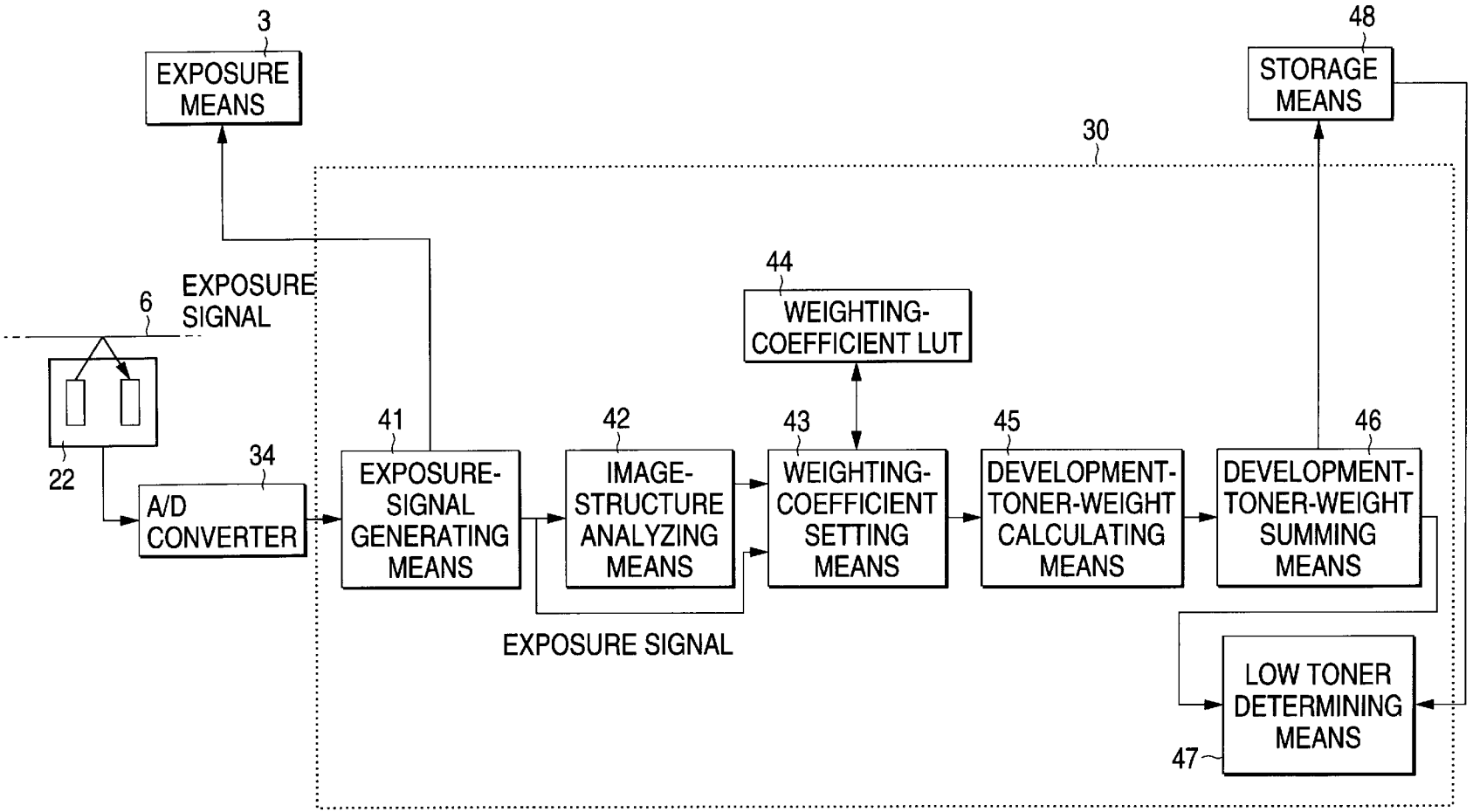
FIG. 4 is a block diagram illustrating an example of a low toner determining device in the aforementioned apparatus.

FIG. 4 shows an example of a low toner determining device in accordance with the present invention. The low toner determining device calculates the amount of toner for each pixel on the basis of the exposure signal, and sums the amount of toner developed with respect to all the pixels so as to estimate the amounts of consumption of the overall toners. The low toner determining device is realized by providing the microcomputer 30 with functions of an exposure signal generating means 41, an image structure analyzing means 42, a weighting coefficient setting means 43, a weighting coefficient LUT 44, a development toner weight calculating unit 45, a development toner weight summing means 46, and a low toner determining means 47.

When the image data, the mode signal, and the patch sensor detection signals are inputted to the exposure signal generating means 41, the exposure signal generating means 41 outputs an en exposure signal to the exposure unit 3 and the image structure analyzing means 42.

The image structure analyzing means 42 analyzes the exposure signal from the exposure signal generating means 41,and thereby determines the image type of the pixel subject to printing.

Here, a description will be given of the image type.

In electrophotography, there is a phenomenon in which the amount of toner attached increases in a boundary portion of the latent image during development. Since this is a phenomenon which occurs due to the concentration of the electric field in the boundary portion, the amount of toner of pixels in a line/dot image or the boundary portion of an image is greater than the amount of toner of pixels in a solid image. The amount of toner in a halftone image becomes an intermediate amount of toner between the pixel of a solid image and the pixel of a boundary portion. The image structure analysis means is used to determine whether the relevant pixel is that of a line/dot image, a solid image, or an intermediate image so as to correct an increase or decrease in the amount of toner mainly due to this phenomenon.

Two signals are inputted to the weighting coefficient setting means 43. In particular, one of the signals inputted to the weighting coefficient setting means 43 is a signal representing the image type of the relevant pixel, as determined by the image structure analyzing means 42. This signal may be referred to as an image type signal. The other of the signals inputted to the weighting coefficient setting means 43 is the exposure signal for the relevant pixel. The weighting coefficient setting means receives the exposure signal from the exposure signal generating means 41.

When the image type as well as the exposure time and the exposure current are given by the exposure signal, the weighting coefficient setting means 43 determines a weighting coefficient by referring to the weighting coefficient LUT 44,and outputs that weighting coefficient to the development toner weight calculating unit 45. The weighting coefficient LUT 44 may be set by the result of experiment or a simulation at the time of the designing of the printer.

The development toner weight calculating unit 45 calculates an amount of toner developed corresponding to the weighting coefficient. The relationship between the amount of toner developed, which is calculated from the exposure signal with this weighting coefficient added thereto, and an actual amount of toner developed, which is consumed by development, can be determined by a prior experiment or simulation, and these two amounts correspond to each other.

The development toner weight summing means 46 sums the amount of toner developed, which is calculated by the development toner weight calculating unit 45, and the summed value of the amount of of toner developed is stored in a nonvolatile storage means 48.

The low toner determining means 47 determines a low toner state by making a comparison between a set value and the summed amount of toner developed, which is estimated repeatedly on each occasion of image formation.

Figure 5:
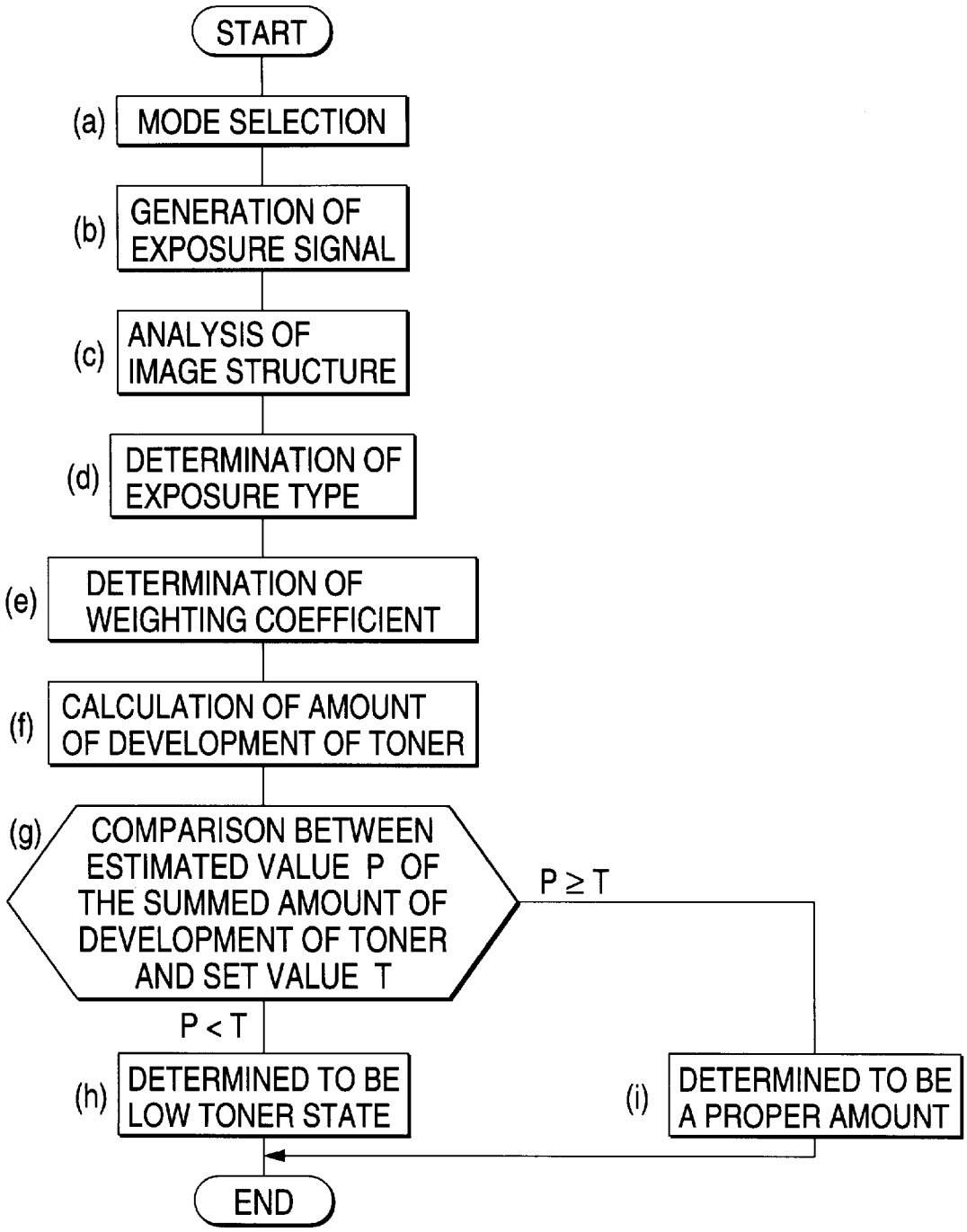
FIG. 5 is a flowchart for explaining the operation of the low toner determining device in the aforementioned apparatus.

Next, referring to the flowchart shown in FIG. 5, a description will be given of the operation of the low toner determining device configured as described above.

First, a mode signal indicating either one of the normal image forming mode and the patch generating mode is selected (Step A). In this state, if the image data, the selected mode signal, and the detection signals from the patch sensor 22 via the A/D converter 34 are inputted to the microcomputer 30, the exposure signal is generated by the exposure signal generating means 41 (Step B). Analysis of the image structure is effected by the image structure analyzing means 42 on the basis of this exposure signal (Step C), and the image type of the relevant pixel is determined (Step D)

Next, if the image type and the exposure time and exposure current of the exposure signal are imparted, a weighting coefficient is determined by referring to the weighting coefficient LUT 44, and is imparted to the exposure signal (Step E). The determined weighting coefficient is inputted to the development toner weight calculating unit 45, and the amount of toner of the relevant pixel is calculated (Step F).

This calculated amount of toner is summed by the development toner weight summing means 46, and the summed value is stored in the nonvolatile storage means 48 and is retained even after the power of the printer is turned off. When the signal indicating an estimated value P of the summed amount of toner developed is inputted to the low toner determining means 47, the estimated value P of the summed amount of development is compared with the set value T, thereby determining a low toner state (Step G).

That is, when the estimated value P of the summed amount of development is less than the set value T, the toner is determined to be in a low toner state (Step H). Meanwhile, if the estimated value P is greater than or equal to the set value T, the toner is determined to be in a proper amount (Step I). Incidentally, if a plurality of levels are set as the set value T, the low toner state can be detected in steps.

Figure 6:
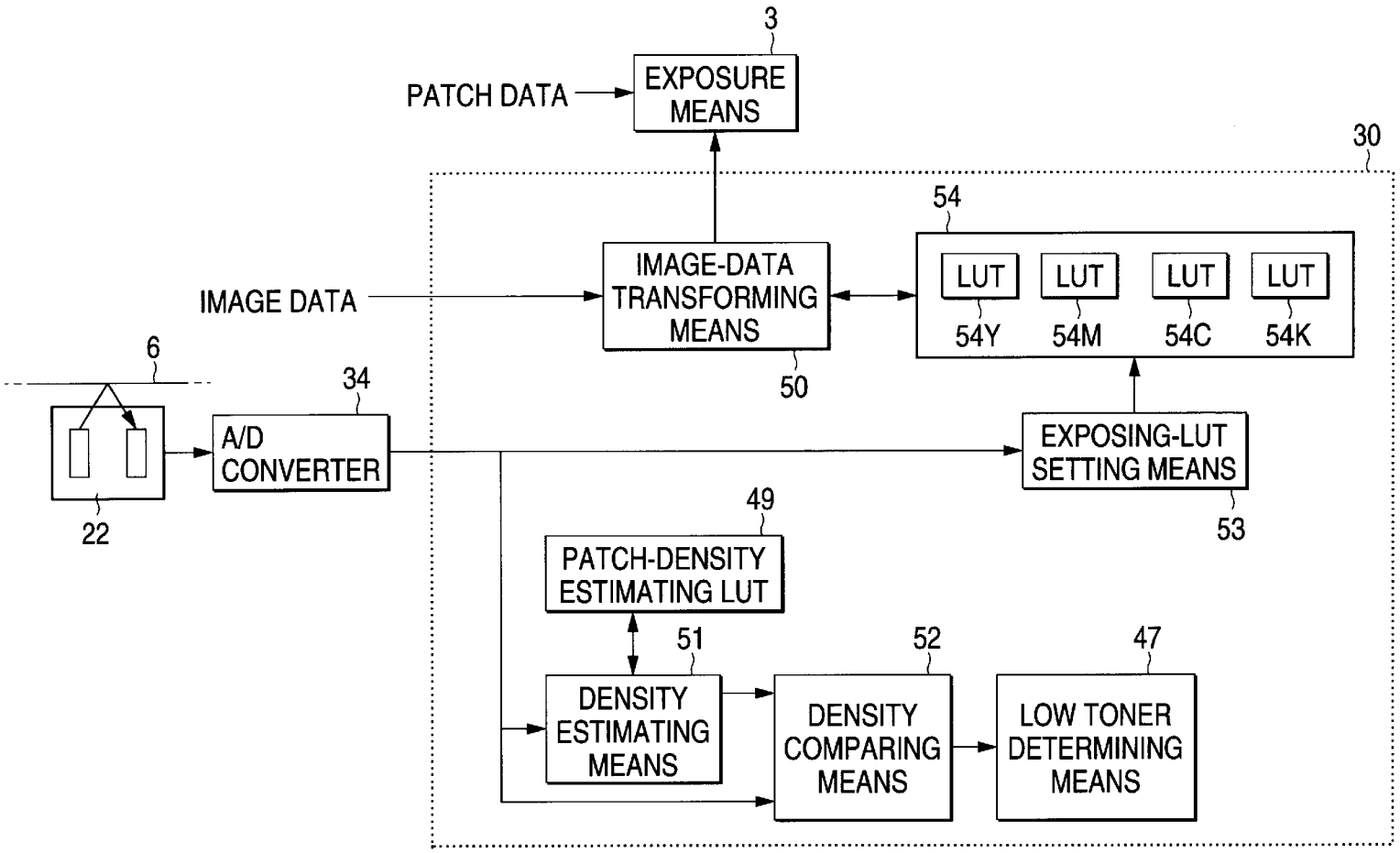
FIG. 6 is a block diagram illustrating another example of the low toner determining device in the aforementioned apparatus.

FIG. 6 shows the low toner determining device for determining the low state of the toner by means of patches in accordance with the present invention. This low toner determining device determines the low toner state in the case where the patch generating mode is selected. Specifically, the microcomputer 30 incorporates functions of an image data transforming means 50, an exposing LUT setting means 53, an exposing LUT 54, a patch density estimating LUT 49, a density estimating means 51, a density comparing means 52, and the low toner determining means 47.

First, a description will be given of patch images used in the detection of the low state of the toner.

Figure 7:
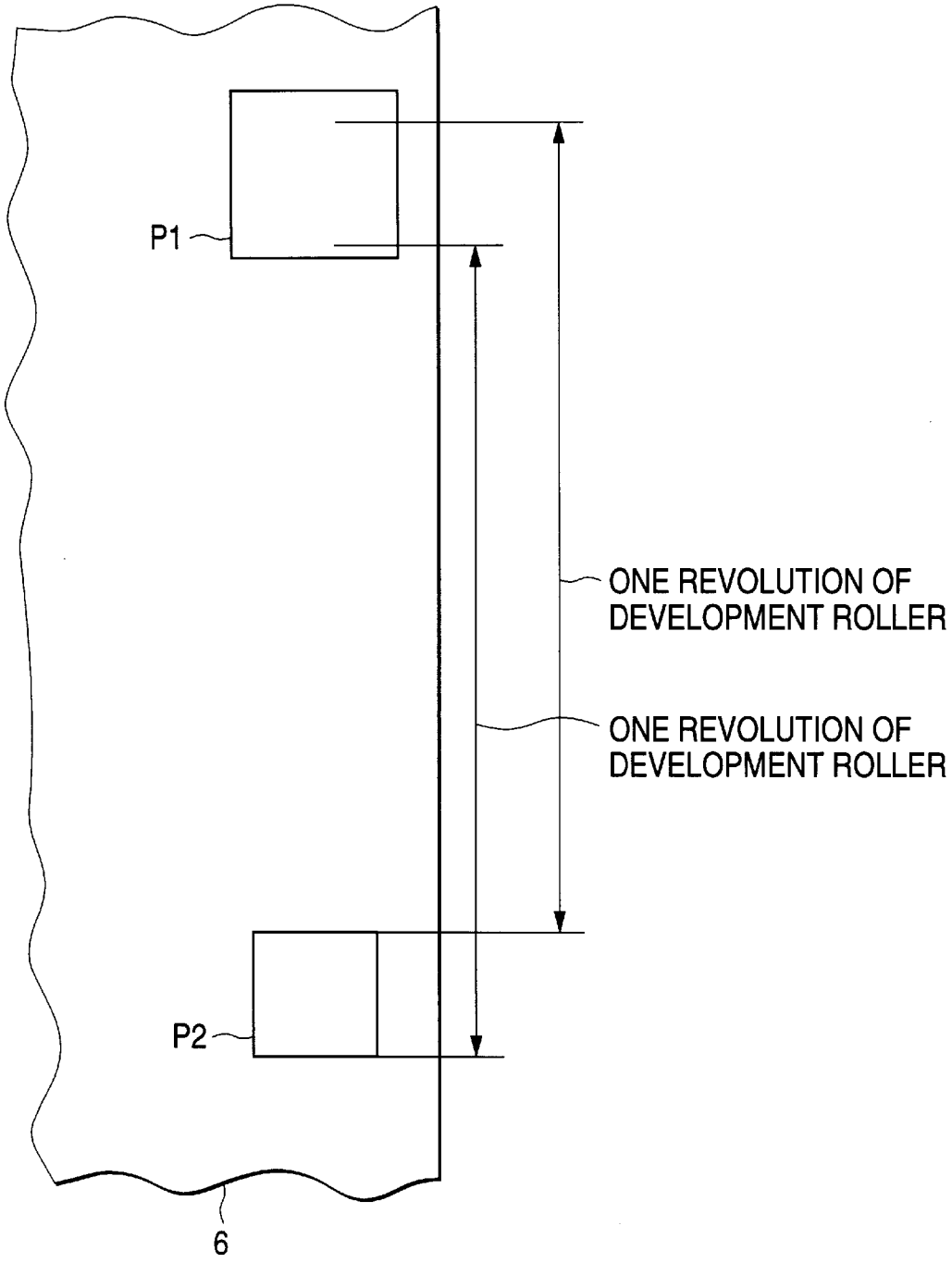
FIG. 7 is an explanatory diagram concerning patch images used in the determination of the low toner state in the aforementioned apparatus.

FIG. 7 is an explanatory diagram concerning the patch images used in the determination of the low toner state, and is a plan view illustrating the positional relationship of the patch images formed on the intermediate transfer member.

P1 denotes a first patch image which is formed on the intermediate transfer member 6 for completely removing the toner from a test region of the development roller 5*d*. P2 denotes a second patch image which is prepared on the intermediate transfer member 6 at a position where the development roller 5*d* as rotated by one revolution from the position where the first patch image P1 is formed. The density of the second patch image P2 is detected by the patch sensor 22.

The arrangement provided is such that the first patch image P1 is set to a solid image (an image with a maximum density) for the purpose of completely attracting the toner on the development roller 5*d*, while the second patch image P2 is set so as to become an image with a halftone density (an intermediate density between a maximum density and a minimum density) for the purpose of detecting subtle fluctuations in characteristics such as a change in the amount of toner.

That is, there is a possibility that the undeveloped toner remaining on the surface of the development roller 5*d* was rubbed repeatedly by the toner inside the developing device 5 and by the restricting blade 5*c*. For this reason, the charged amount has increased or decreased, so that the first patch image P1 developed by this toner does not show a density which reflects the amount of toner in the developing device 5. However, since the second patch image P2 is an image which was developed by the toner which was newly attached after the removal of the toner, the second patch image P2 shows a density which is dependent on the characteristics, particularly the amount of toner, of the developing device 5.

Next, returning to FIG. 6, a description will be given of the respective units.

When the detection signals from the patch sensor 22 via the A/D converter 34 are inputted to the exposing LUT setting means 53, the exposing LUT setting means 53 sets exposing LUTs 54Y, 54M, 54C, and 54K on the basis of measured density values of the patch images in the respective colors, C, M, Y, and K, generated on the intermediate transfer member 6, and cancels fluctuations in tone reproducibility.

The image data transforming means 50 transforms the inputted image data into an exposure signal on the basis of the exposing LUTs 54Y, 54M, 54C, and 54K set by the exposing LUT setting means 53, and outputs the same to the exposure unit 3.

The density estimating means 51 estimates the ambient environment and the like on the basis of a reading of the Y patch of the first color, and consecutively estimates readings of the M patch of the second color through the K patch of the fourth color by using the patch density estimating LUT 49. The density comparing means 52 makes a comparison between, on the one hand, an estimated value of the M patch estimated from the reading of the Y patch of the first color and, on the other hand, the readings of the M patch of the second color through the K patch of the fourth color which are read consecutively.

The low toner determining means 47 determines whether the toners of the respective colors are in the low toner state on the basis of agreement between the reading and the estimated value compared by the density comparing means 52.

FIGS. 8 through 11 are flowcharts for explaining the operation of the low toner determining device in the patch generating mode.

First, when the mode is set in the patch generating mode, patch images in the respective colors, C, M, Y, and K, are generated on the intermediate transfer member 6 by the above-described process, and the densities of the second patch image P2 are read in the order of Y, M, C, and K by the patch sensor 22. When the density of the Y patch image of the first color is read (Step A in FIG. 8), the exposing LUT 54Y for Y is set on the basis of its measured density value (Step B in FIG. 8). Then, after the fluctuation in tone reproducibility is canceled, the ambient environment and the like are estimated from the measured density value of the Y patch, and the measured density value of the M patch image of the second color is estimated by using the patch density estimating LUT 49 (Step C in FIG. 8).

Figure 8:
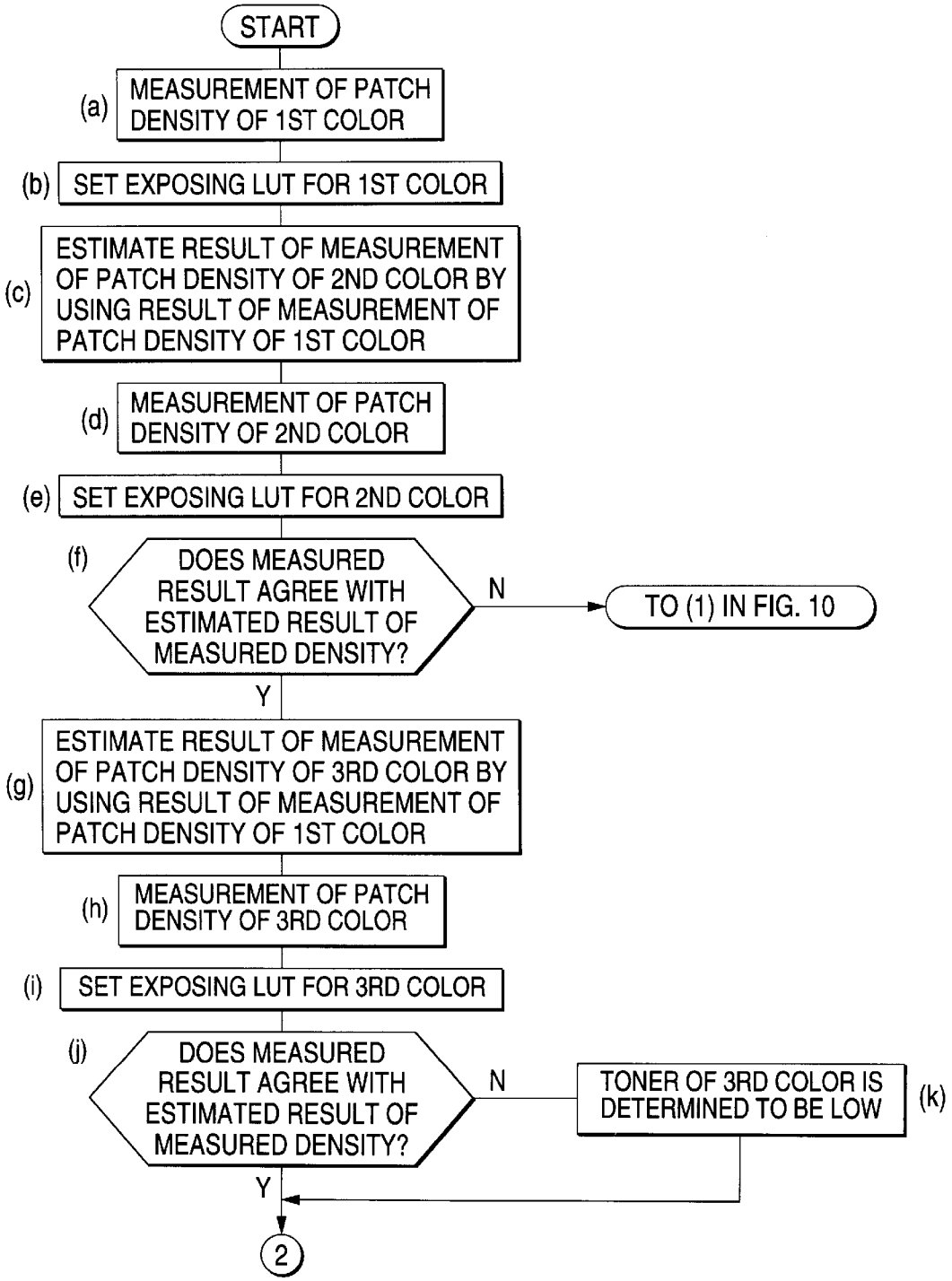
FIG. 8 is a flowchart.(part 1) for explaining the operation of the low toner determining device in a patch generating mode in the aforementioned apparatus.

Next, the density of the M patch image is read (Step D in FIG. 8), and the exposing LUT 54M for M is set on the basis of its measured density value (Step E in FIG. 8). In addition, this measured density value is compared with the estimated density value of Step C (Step F in FIG. 8), and if they agree, the density value of the C patch image of the third color is estimated from the density reading of the Y patch image of the first color by using the patch density estimating LUT 49 (Step G in FIG. 8), whereas if they do not agree, the operation proceeds to Step A in FIG. 10. The estimation of this density may be effected on the basis of the measured density value of the M patch image of the second color, or may be effected on the basis of the measured density values of both the Y patch image and the M patch image. In other words, an estimated toner consumption (which was obtained in Step C) is compared with a measured, or a determined toner consumption (which was obtained in Steps D and E). When the estimated toner consumption differs from the determined toner consumption by a significant amount (i.e., by an amount that meets/exceeds a threshold), then the two values do not agree. This threshold may be referred to as a low toner threshold or as a difference threshold.

Then, when the density value of the C patch image is read (Step H in FIG. 8), the exposing LUT 54C for C is set on the basis of its measured density value (Step I in FIG. 8). A comparison is made between the measured density value of the C patch image and the estimated density value estimated by using the patch density estimating LUT 49 in Step G in FIG. 8 (Step J in FIG. 8), and if they agree, the operation proceeds to Step A in FIG. 9. If they do not agree, a determination is made that the C toner of the third color is in a low toner state (Step K in FIG. 8). In this way, on the basis of agreement between the measured density value and the estimated density value of the set patch image for each color, a determination is made as to whether or not the toner of any one of the colors, C, M, Y, and K, is in the low toner state.

Figure 9:
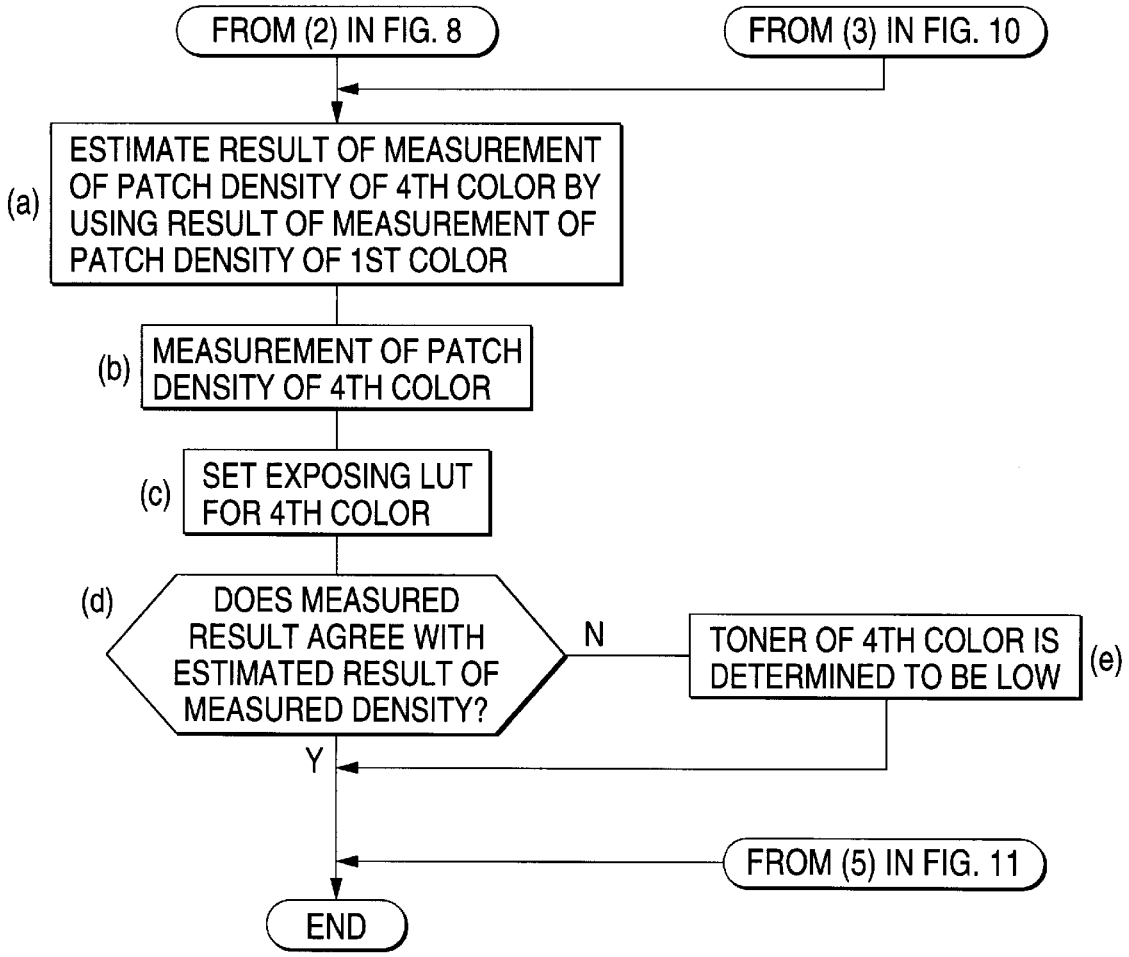
FIG. 9 is a flowchart (part 2) for explaining the operation of the low toner determining device in the patch generating mode in the aforementioned apparatus.

The operation then proceeds to the flowchart shown in FIG. 9 to effect processing with respect to the K patch image of the fourth color in a manner similar to that for the C patch image (Steps A to E in FIG. 9). In this processing, the exposing LUT 54K for K is set, and if agreement is obtained between the measured density value and the estimated density value estimated by using the patch density estimating LUT 49, the processing ends as it is. If they do not agree, a determination is made that the K toner is in the low toner state.

Figure 10:
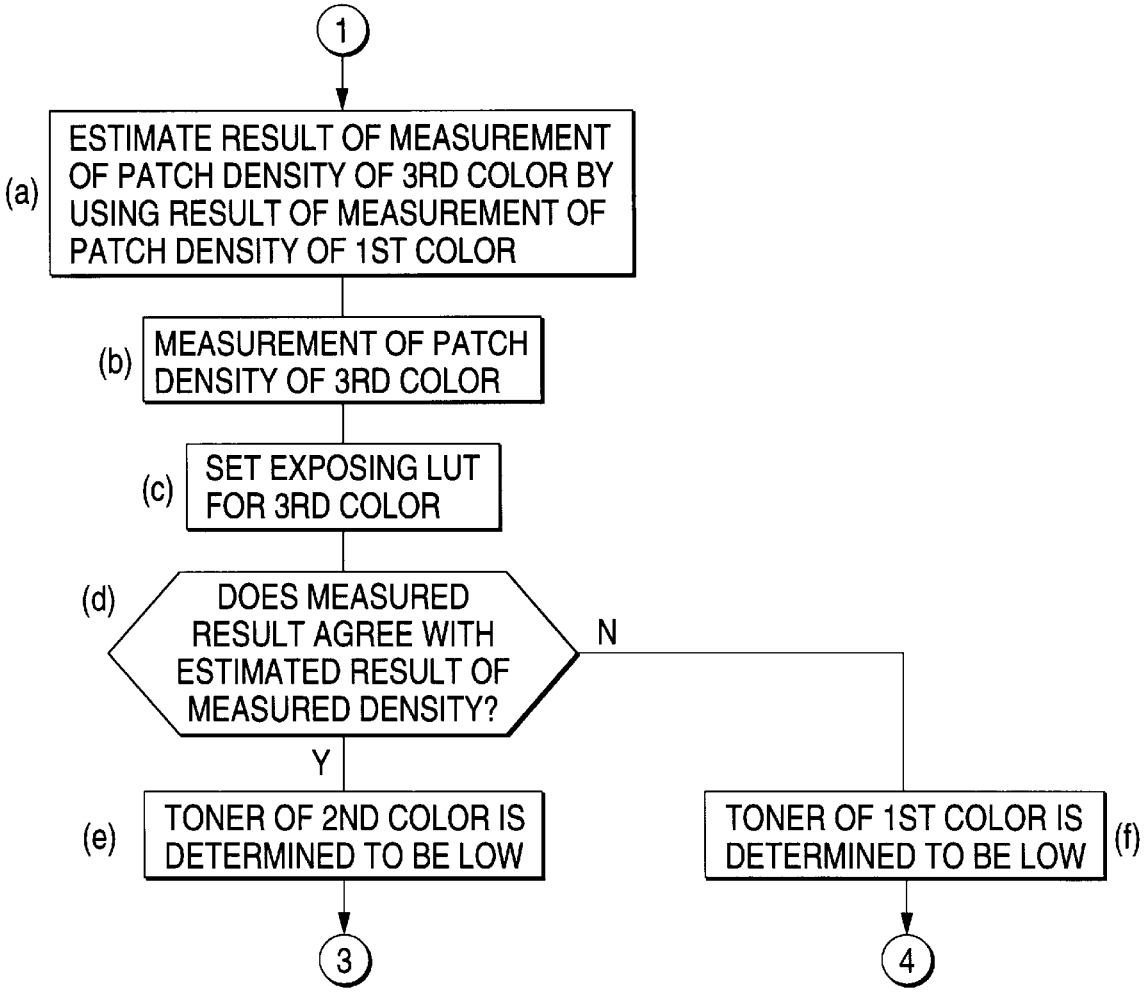
FIG. 10 is a flowchart (part 3) for explaining the operation of the low toner determining device in the patch generating mode in the aforementioned apparatus.

Then, if the measured density value and the estimated density value of the M patch image do not agree in the determination of Step F in FIG. 8, the operation proceeds to Step A in FIG. 10. Cases where the values do not agree with each other include a case where the M toner of the second color is in the low toner state and a case where the Y toner of the first color is in the low toner state and the estimation of the ambient environment estimated on the basis thereof is erroneous.

The processing in Steps A to C in FIG. 10 is substantially the same as the processing in Steps G to I in FIG. 8. The density value of the C patch image of the third color is estimated from the density reading of the Y patch image of the first color (Step A in FIG. 10), and if the density value of the C patch image is read (Step B in FIG. 10), the exposing LUT 54C for C is set on the basis of its measured density value (Step C in FIG. 10).

Next, a determination is made as to whether or not the measured density value and the estimated density value of the C patch image agree with each other (Step D in FIG. 10), and if they agree, a determination is made that not the Y toner but the M toner is in the low toner state (Step E in FIG. 10). If they do not agree, a determination is made that the estimation based on the Y patch image is erroneous, and a decision is made that the Y toner is in the low toner state (Step F in FIG. 10).

When the M toner is in the low toner state (Step E in FIG. 10), the operation proceeds to Step A in FIG. 9 to detect the low toner state of the K toner by using the estimated density value based on the aforementioned measured density value of the Y patch image. Meanwhile, when the Y toner is in the low toner state (Step F in FIG. 10), the operation proceeds to Step A in FIG. 11.

Figure 11:
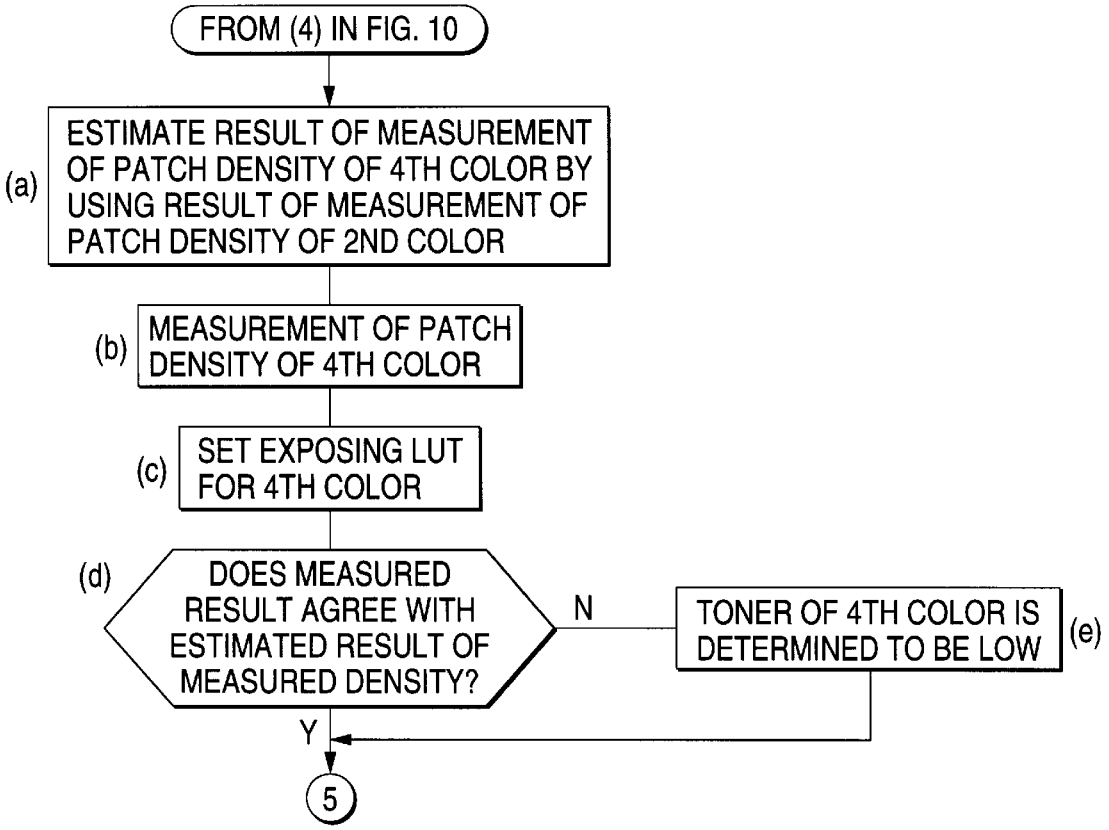
FIG. 11 is a flowchart (part 4) for explaining the operation of the low toner determining device in the patch generating mode in the aforementioned apparatus.

In this state, since the Y toner is in the low toner state, the estimated density value of the K patch image is determined on the basis of the estimated density value of the M patch image of the second color instead of using the estimated density value based on the measured density value of the Y toner (Step a in FIG. 11). Then, in the same way as in Steps B to E in FIG. 9, the density of the K patch image of the fourth color is read and is compared with the estimated density value (Step D in FIG. 11), and a determination is made as to whether or not the K toner of the fourth color is in the low toner state, whereupon the processing ends.

It should be noted that, as described above, cases where the estimated density value and the measured density value of the M patch do not agree with each other in the determination in Step F in FIG. 8 and the operation proceeds to Step A in FIG. 10 include the case where the M toner is in the low toner state and the case where the Y toner is in the low toner state. In most cases, such disagreement occurs only in either one of the aforementioned cases. On rare occasions, however, there are cases where both the Y toner and the M toner assume the low toner state.

To cope with such a case, it suffices if the low state determination processing is effected with respect to toners of all the colors, and the low state determination processing then effected again by shifting the order of colors, such as forming the C patch image for the first color and forming the K patch image for the second color. In addition, if the order of color for determination is shifted each time the patch generating mode is started, the case where a plurality of toners have assumed the low state simultaneously can be detected without extending the time required for detecting the low toner state.

The information that the toner has assumed the low toner state may be notified to the user by means of a display panel, a display lamp, a buzzer, or the like provided on the printer. Alternatively, a signal for notifying a host computer or the like on the low toner state may be generated to notify the user by using a host side display unit.

Thus, since the patch images for setting exposing LUTs for correcting fluctuations in the tone reproducibility of the apparatus due to changes in the environment and the patch images for detecting the low toner state are made common, as compared with the case where patch images are individually generated, it is possible to reduce the amount of consumption of toner used in the formation of patch images and the time required for the formation of patch images. In addition, even if the densities of patch images have changed due to changes in the environment, since fluctuating portions of densities in the case where the amount of toner has not reached the low state are estimated, it is possible to accurately determine the low toner state irrespective of the environmental changes.

The estimation of patch densities in Steps C and G in FIG. 8, Step A in FIG. 9, Step A in FIG. 10, and Step A in FIG. 11 becomes possible if the densities of patch images of the respective colors in each environment are measured in advance, and the patch density estimating LUT 49 is formulated by relating estimated density values to the Y patch image and the M patch image, respectively. Tables 1 and 2 below show examples of the patch density estimating LUT 49 in the above-described cases.

| Y-Patch Density | Estimated Value of M-Patch Density | Estimated Value of C-Patch Density | Estimated Value of K-Patch Density |
|---|---|---|---|
| 0.40 | 0.42 | 0.41 | 0.44 |
| — | — | — | — |
| — | — | — | — |
| 0.45 | 0.46 | 0.46 | 0.50 |
| — | — | — | — |
| — | — | — | — |
| — | — | — | — |
| 0.50 | 0.50 | 0.51 | 0.56 |
| — | — | — | — |
| — | — | — | — |
| — | — | — | — |

-continued

| M-Patch Density | Estimated Value of Y-Patch Density | Estimated Value of C-Patch Density | Estimated Value of K-Patch Density |
|---|---|---|---|
| 0.40 | 0.38 | 0.39 | 0.42 |
| — | — | — | — |
| — | — | — | — |
| — | — | — | — |
| 0.45 | 0.44 | 0.45 | 0.49 |
| — | — | — | — |
| — | — | — | — |
| — | — | — | — |
| 0.50 | 0.50 | 0.51 | 0.56 |
| — | — | — | — |
| — | — | — | — |
| — | — | — | — |

The aforementioned patch density estimating LUT 49 is stored in advance in a factory at the time of shipment of the apparatus, and such data can be stored by consecutively accumulating measured density values during an initial period of operation of the image forming apparatus. That is, processing in which measured density values of patch images of other colors are made to correspond to the measured density value of the patch image of the first color is carried out for a period when the amount of toner does not reach a low state during an initial period of operation of the image forming apparatus, e.g., until the time of printing of 1000 sheets of paper, and the low toner state determination is subsequently effected in the same way as described above. In this way, it is possible to prevent an erroneous determination ascribable to differences among individual image forming apparatuses.

In accordance with this embodiment, since the patch density estimating LUT 49 can be prepared in a state which conforms to the user's working environment, table data in density ranges of patch images whose frequency of use is high can be prepared with precision. With respect to density ranges of patch images whose frequency of use is low, even though the data may become rough, it is possible to obtain estimated values for the respective densities through linear interpolation or the like. In addition, if estimated density values are prepared in advance with respect to measured density values which are estimated under extreme environments, it is possible to improve the accuracy of interpolation.

Further, default data which is measured in advance is incorporated at the time of shipment of the image forming apparatus by combining the above-described estimated density values, and the table data is corrected by using the data detected at the time of actual operation, the low toner state can be detected immediately after a startup subsequent to the setup of the apparatus. Hence, even if large volumes are printed immediately after the startup, the low toner state can be detected in practical use without trouble.

It should be noted that the second patch image P2 may be of the same size as the first patch image P1,but if the size of the second patch image P2 is set to a size slightly smaller than that of the first patch image P1, the second patch image P2 can be formed with the toner which was newly attached to the region of the development roller 5*d* where the toner on the surface was once developed reliably and completely at the first patch image P1.

In addition, two patch images of halftone densities are prepared for each color, and measurement is effected by using one of them. However, a plurality of patch images may be prepared for each color so as to be developed at identical positions on the development roller 5*d* and may be used in the setting of exposure conditions and parameters of the process by measuring the tone reproduction characteristics. Further, by calculating the_γ-characteristic values through the densities of the plurality of patch images, it is possible to detect the low toner state on the basis of the_γ-characteristic values.

Figure 12:
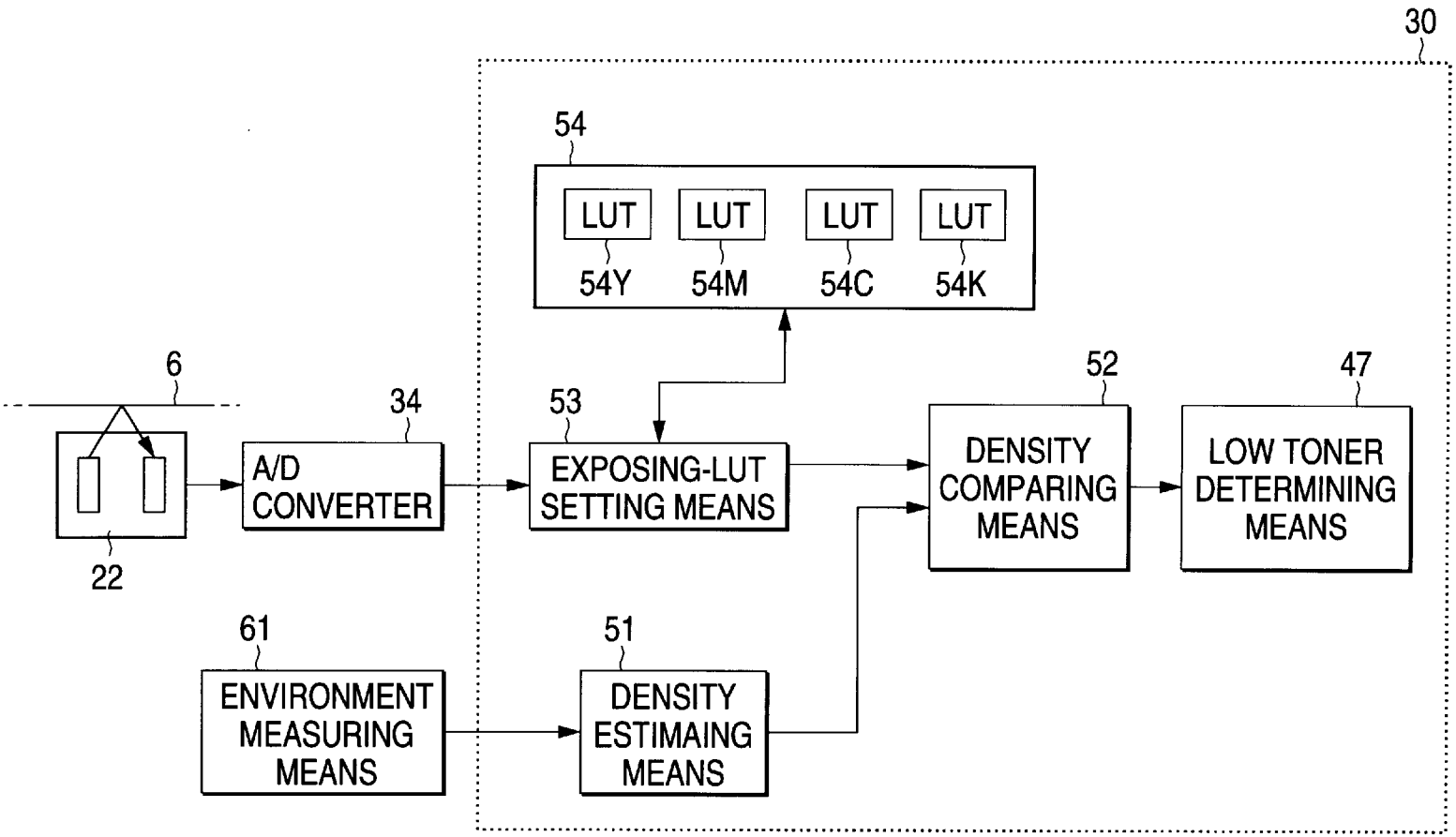
FIG. 12 is a block diagram illustrating an example of the low toner determining device provided with the function for measuring the environment inside the aforementioned apparatus.

FIG. 12 shows an example of the low toner determining device which detects the low toner state by using a sensor.

This low toner determining device is comprised of an environment measuring means 61 and the microcomputer 30, and the microcomputer 30 incorporates functions of the density estimating means 51, the density comparing means 52, the exposing LUT setting means 53, the exposing LUT 54 corresponding to the four colors, C, M, Y, and K, and the low toner determining means 47.

The environment measuring means 61 is comprised of a temperature sensor and a humidity sensor which are disposed at appropriate places inside the apparatus, while the density estimating means 51 is arranged to estimate estimated density values of patch images of the respective colors from measured environmental parameters.

The exposing LUT setting means 53 sets the exposing LUT 54 on the basis of the measured density values, and cancels fluctuations in the tone reproducibility. The density comparing means 52 makes a comparison between the measured density values of the patch images set by the exposing LUT 54 on the one hand, and the estimated density values estimated by the density estimating means 51.

Referring to the flowcharts shown in FIGS. 13 and 14, a description will be given of the operation of the apparatus configured as described above.

Figure 13:
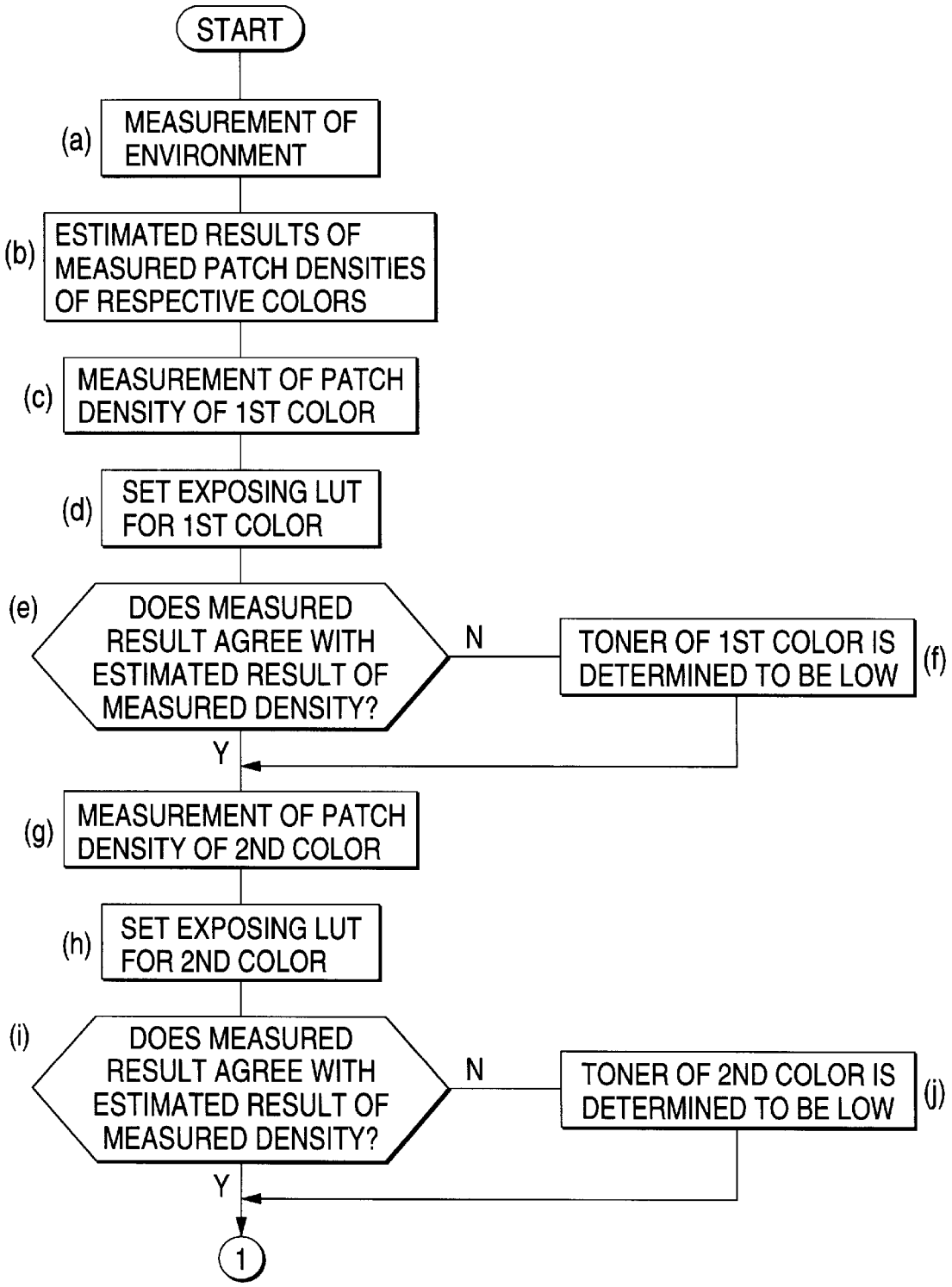
FIG. 13 is a flowchart (part 1) in a case where the low toner state is determined on the basis of the result of measurement of the environment inside the aforementioned apparatus.
Figure 14:
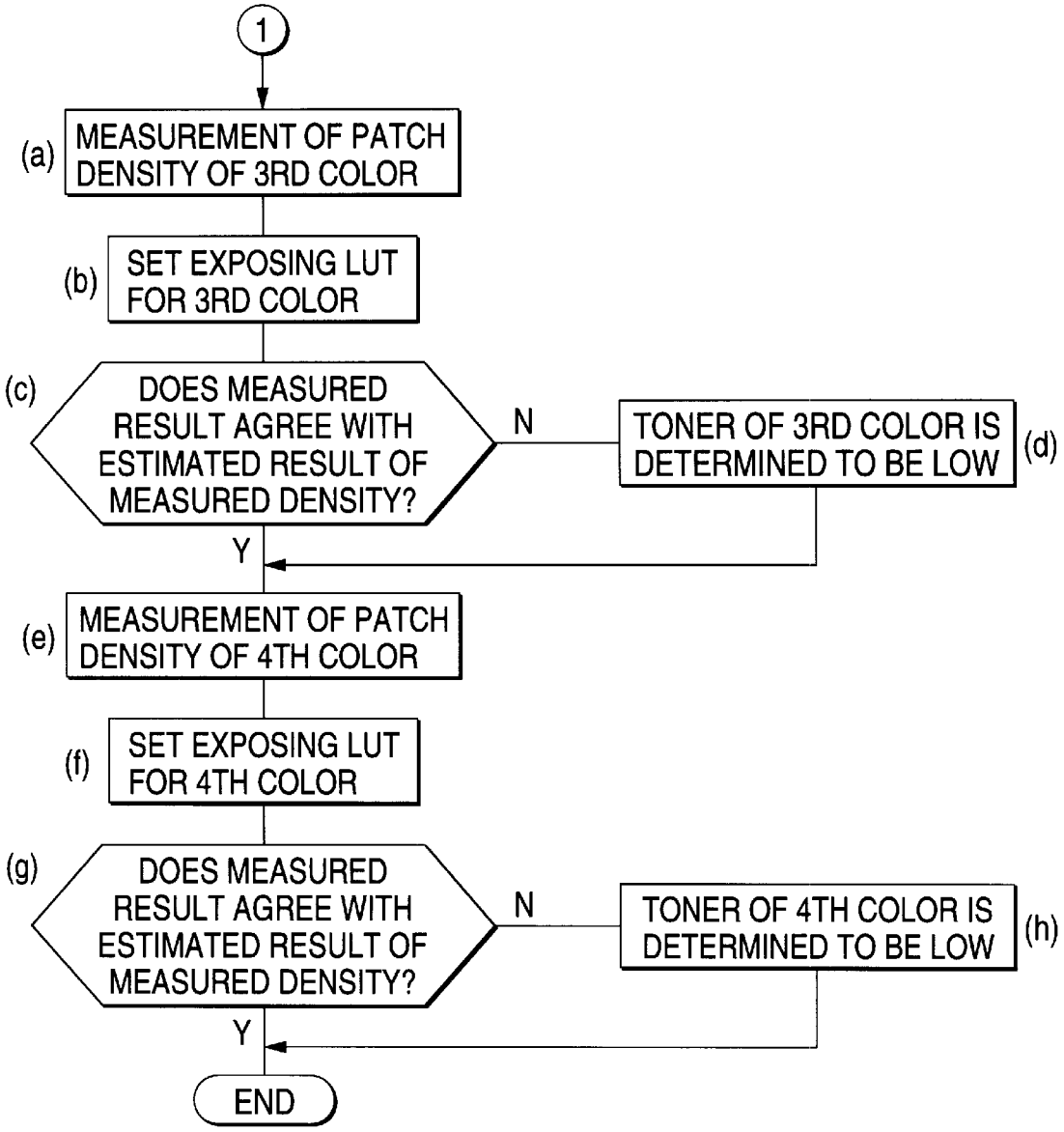
FIG. 14 is a flowchart (part 2) in a case where the low toner state is determined on the basis of the result of measurement of the environment inside the aforementioned apparatus.

When the mode is set to the patch generating mode, the environment is measured by the environment measuring means 61 (Step A in FIG. 13), and estimated density values of the patch images of the respective colors are estimated (Step B in FIG. 13).

Then, by the same means as the one used in the above-described patch formation, a patch image of a first color is actually formed, and its density is measured (Step C in FIG. 13). The exposing LUT 54 is set on the basis of the result (Step D in FIG. 13), and a comparison is made between the measured density value and the estimated density value (Step E in FIG. 13). If they do not agree, the toner of the first color is determined to be in the low toner state (Step F in FIG. 13). This processing (Steps C to F in FIG. 13) is repeated for each color (Steps G to J in FIG. 13 and Steps E to H in FIG. 14) so as to detect the low toner state for each color.

Since the environment is detected in the above-described manner, even when a plurality of toners have assumed the low toner state, it is easily possible to determine that state. In particular, even when all the toners have assumed the low toner state, it is easily possible to determine that state.

Figure 15:
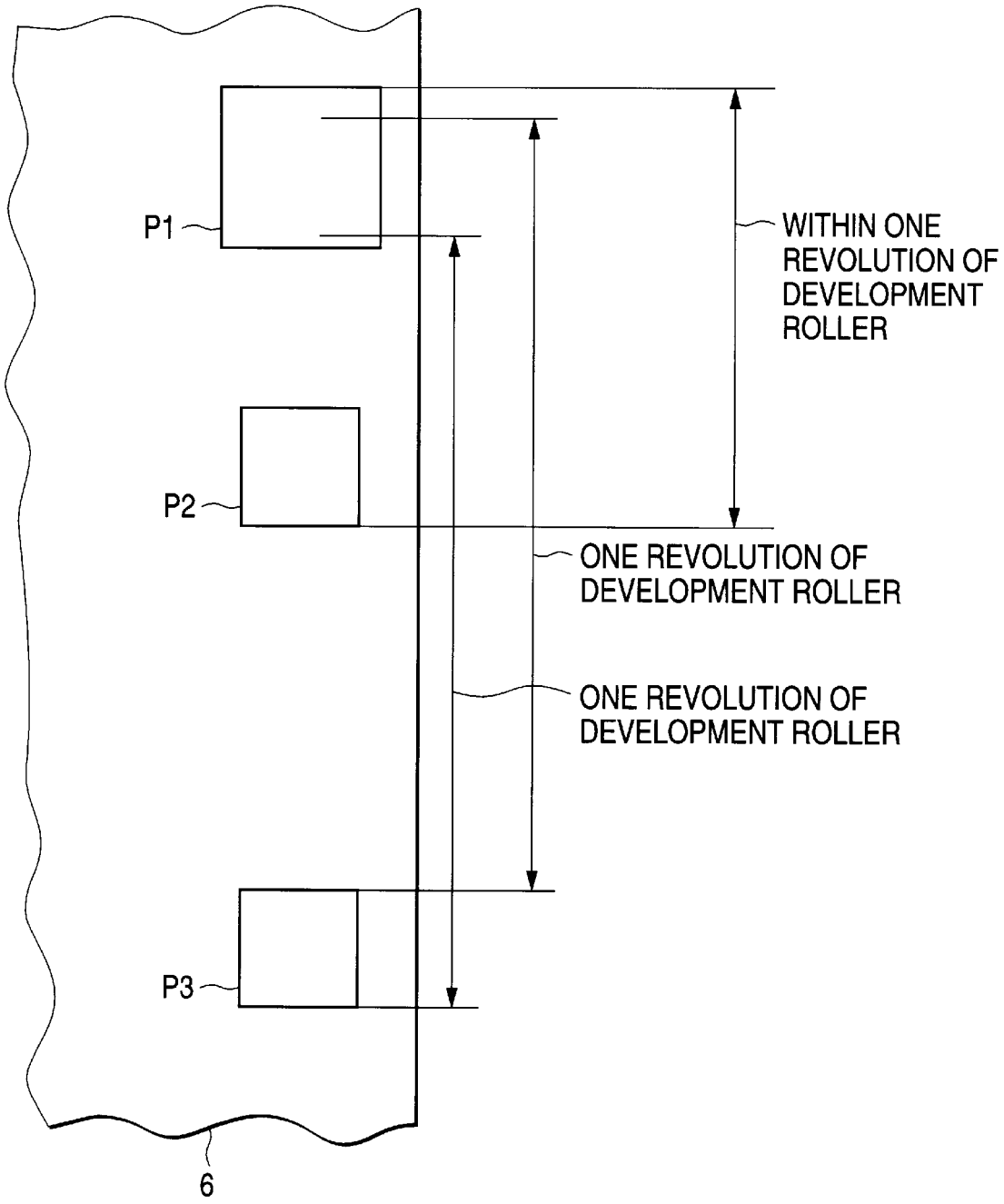
FIG. 15 is an explanatory diagram of another example of patch images used in the determination of the low toner state in the aforementioned apparatus.

FIG. 15 is a plan view of a second example of the patch images used in the determination of the low toner state, and illustrates the positional relationship of the patch images formed on the intermediate transfer member.

The first, second, and third patch images P1, P2, and P3 are formed on the intermediate transfer member 6. The first patch image P1 is formed as a solid image, while the second and third patch images P2 and P3 are formed as those having halftone densities. The patch image P2 and the patch image P3 are patch images which are formed under the same conditions of exposure, development, and the like, and their densities are measured by the patch sensor 22. By the time these patch images are to be formed, the development roller 5*d* has been rotated idly by a number of revolutions.

That is, the toner, which can be properly printed after having been rubbed with the toner 5*b* inside the developing device, the restricting blade 5*c*, and the like, is present on the surface of the development roller 5*d*. The patch images P1 and P2 are patch images which are formed by such a toner. When the patch image P1 is developed, the toner on the surface of the development roller 5*d* completely moves to the photoconductive member 1. The patch image P3 is a patch image which is formed at a position which is delayed by a one revolution portion of the development roller 5*d* from the patch image P1, and is developed by the toner which has been newly attached to the region where the patch image P1 on the surface of the development roller 5*d* was developed immediately before. That is, the patch image P3 is a patch image formed by the toner which was replenished to the surface portion of the development roller 5*d* while the development roller 5*d* made one revolution.

The measured density values of the patch image P2 and the patch image P3 are compared with each other. If the difference between the measured density values of the two patch images is greater than or equal to a predetermined density value, the toner is determined to be in the low toner state. The results of the last two determinations are stored, and if the results of three determinations including those results continuously indicate the low toner state, the user is notified of the low toner state, thereby accurately determining the low toner state.

In addition, after the low toner state is notified to the user, the data is arranged to determine the measured density value itself of the third patch image P3, and if its density value is lower than the set value, the toner is determined to be in the low toner state. As a result, the no toner state can be detected without requiring the no toner state detecting means. This set value may be referred to as a no toner threshold or as a low density threshold.

Further, if the amount of toner decreases to a level immediately before the no toner state, the densities of both the second patch image P2 and the third patch image decrease, and the difference between their densities becomes very small, so that it becomes impossible to detect the low toner state. However, in this embodiment, when the density of the third patch image P3 has decreased to a degree which makes it impossible to detect the low toner state, the determination is not effected by using the difference between the measured density values of the second patch image P2 and the third patch image P3, and the low toner state is determined by the density value itself of the third patch image P3,thereby preventing a return to the state of nondetection.

In addition, if the toner is determined to be in the low toner state, since the charged amount differs between the toner remaining undeveloped on the surface of the development roller 5*d* and the toner newly supplied to the surface of the development roller 5*d*, their development characteristics differ. For this reason, the exposure conditions are set for each history of the toner which is present on the development roller 5*d*. Then, whether each dot for forming the image is developed by the remaining toner or is developed by the new toner is determined by the relationship between, on the one hand, the circumferential length of the development roller 5*d* and, on the other hand, the ratio in the peripheral speed between the photoconductive member 1 and the development roller 5*d*.

For example, in a case where the circumferential length of the development roller 5*d* is 60 mm, and the peripheral speed at the surface of the development roller 5*d* relative to the surface of the photoconductive member 1 is twice as large in the same direction, a dot D2, which is located at the same position as a certain dot D1 in the scanning direction and is located 30 mm downstream in the traverse direction, i.e., in the image advancing direction, is generated by the same portion as the one which generated the dot D1 on the surface of the development roller 5*d*. At this time, the toner located on the development roller 5*d* when developing the dot D1 moves to the photoconductive member 1,so that the dot D2 is developed by new toner. Accordingly, when the dot D2 is exposed, the exposure conditions are determined on the basis of the measured density value of the third patch image P3.

Since the dot D1 is developed by the remaining toner if the dot D1 is located within 30 mm from a leading end of the image or if a dot is not located 30×I mm (I=1, 2, 3, . . . ) upstream in the traverse direction, the exposure conditions are determined on the basis of the measured density value of the patch image P2. By providing such an arrangement, each dot is formed under optimum exposure conditions, and even when the toner is in the low toner state it is possible to obtain a high quality image which is free of unevenness to the greatest possible extent.

Figure 16:
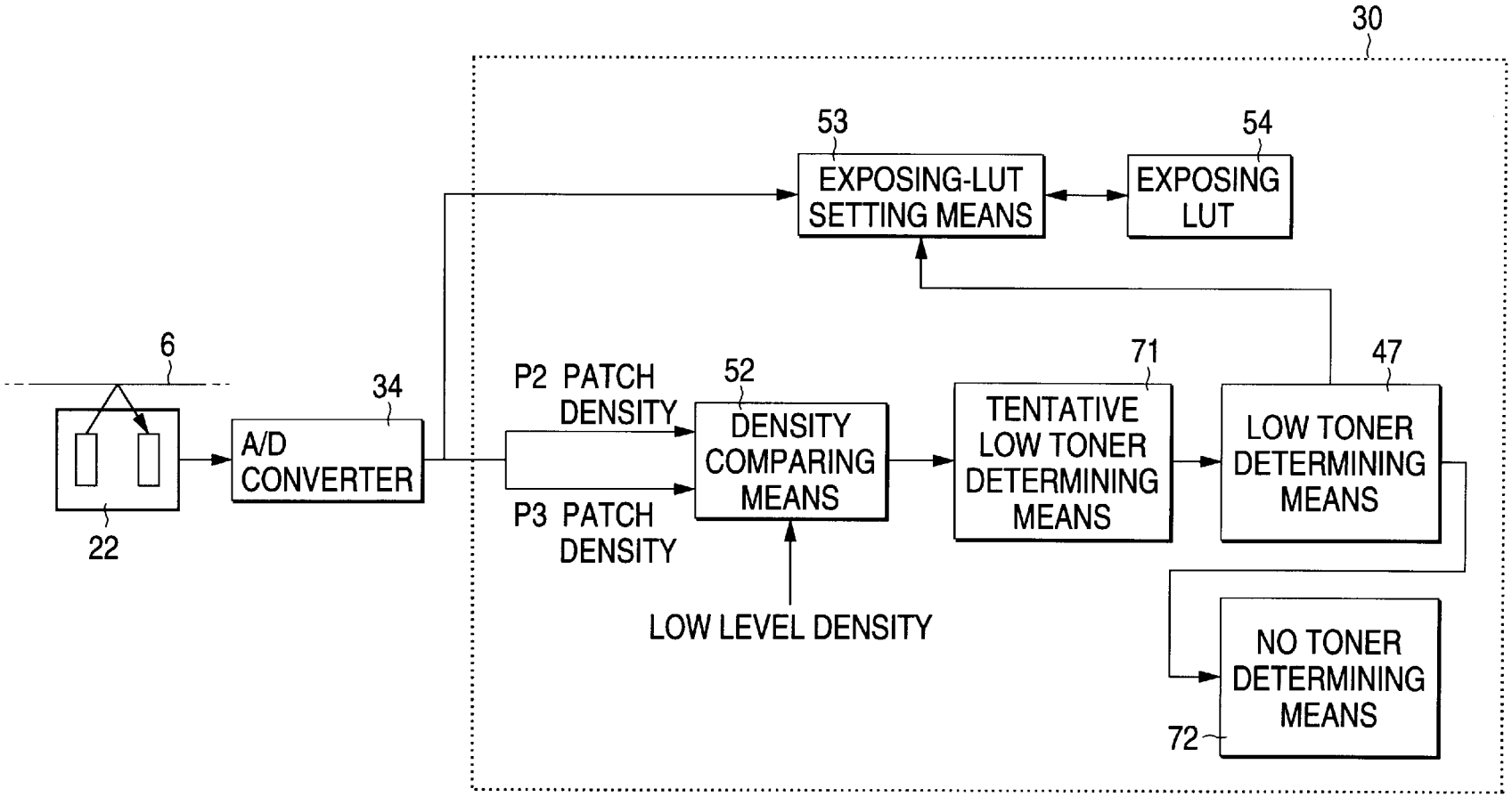
FIG. 16 is a block diagram illustrating an example of a low toner and no toner determining device in the aforementioned apparatus.

FIG. 16 shows an example of the low toner and no toner determining device in a case where the patch images shown in FIG. 15 are used.

This low toner determining device is configured by incorporating in the microcomputer 30 functions of the exposing LUT setting means 53, the exposing LUT 54, the density comparing means 52, a low toner state tentative determination means 71,the low toner determining means 47, and a no toner determining means 72.

The exposing LUT setting means 53 sets the exposing LUT 54 on the basis of the measured density values of the second patch image P2 and the third patch image P3 on the intermediate transfer member 6 which are measured by the patch sensor 22. The density comparing means 52 makes a comparison between the set values and the measured density values of the second patch image P2 and the third patch image P3 which are formed on the intermediate transfer member 6.

The low toner state tentative determination means 71 tentatively determines that the amount of toner has decreased more than the low toner state if the measured density value measured by the patch sensor 22 is less than a set value, or if the difference in density between the second patch image P2 and the third patch image P3 is greater than or equal to a set value. The low toner determining means 47 determines that the toner is in the low toner state in a case where tentative determinations by the low toner state tentative determination means are consecutively made a predetermined number of times.

Upon receiving the result of the low toner state tentative determination means 71, the no toner determining means decides that the toner is in the no toner state by determining that the amount of toner in the developing device 5 is very small if the density of the third patch image P3 is less than an even lower set value.

Figure 17:
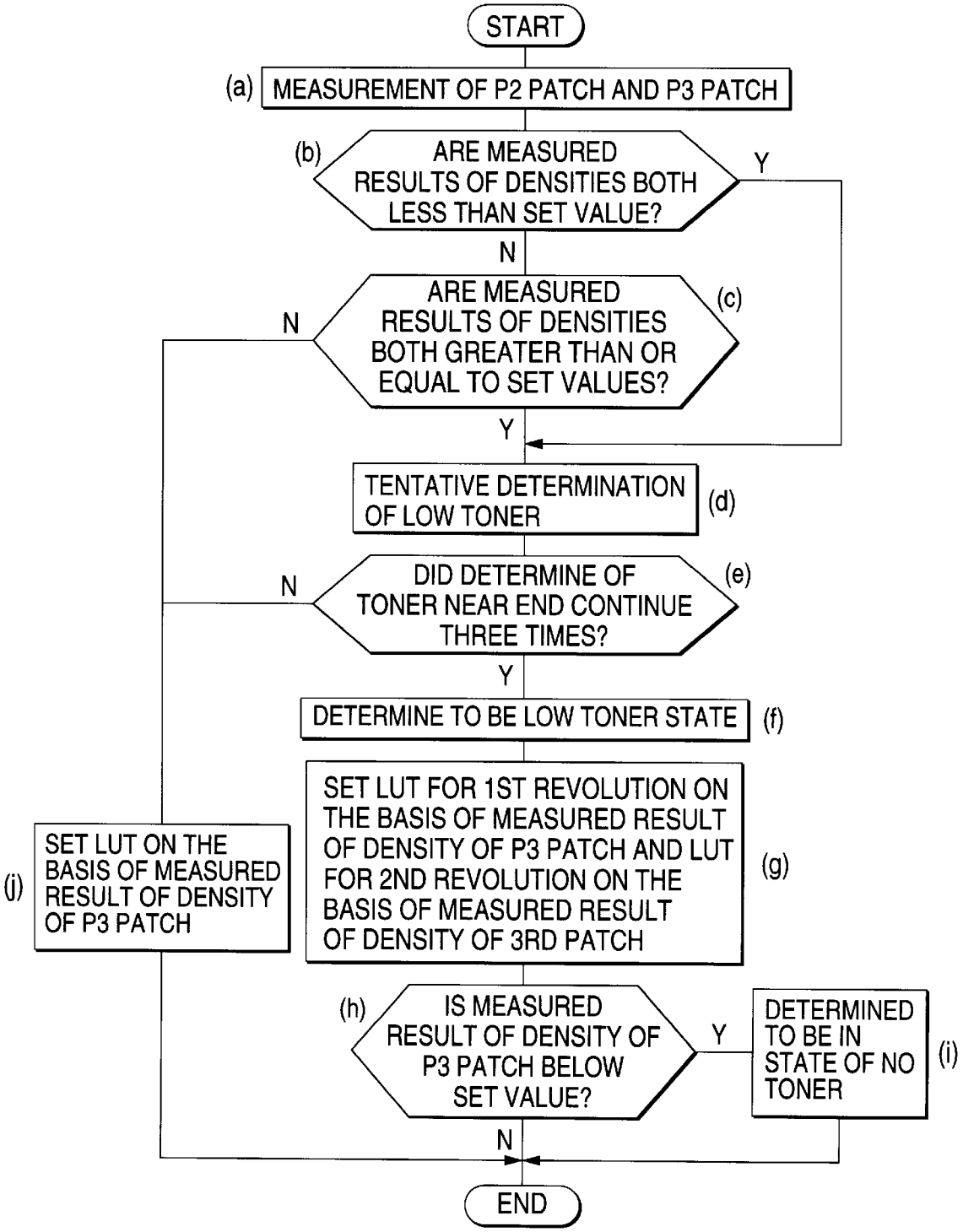
FIG. 17 is a flowchart in a case where the low toner state and the no toner state are determined in the aforementioned apparatus.

FIG. 17 is a flowchart for explaining the operation of the low toner and no toner determining device shown in FIG. 16.

The densities of the second patch image P2 and the third patch image P3 formed on the intermediate transfer member 6 in the patch generating mode are measured by the patch sensor 22 (Step A in FIG. 17). If the measured density values are both below a set value (Step B in FIG. 17), it is determined that the amount of toner has decreased more than the low toner state, so that the operation proceeds to the tentative determination of the low toner state (Step D in FIG. 17). If the measured density values are greater than or equal to the set value, the ordinary low toner state determination is made, and a determination is made as to whether the difference in density between the second patch image P2 and the third patch image P3 is greater than or equal to a set value (Step C in FIG. 17).

If the density difference is greater than or equal to the set value, it is tentatively determined that the toner is in the low toner state (Step D in FIG. 17). Meanwhile, if the density difference is less than the set value, a determination is made that the toner is not in the low toner state. If it is tentatively determined that the toner is in the low toner state, a check is made on whether the tentative determination continued for three consecutive times (Step E in FIG. 17). If the tentative determination continued for three consecutive times, it is determined that the toner is in the low toner state (Step F in FIG. 17). If the tentative determination has not continued for three consecutive times, it is determined that the toner is not in the low toner state, and that an error has occurred in the past determination.

If it is determined that the toner is in the low toner state, the exposing LUT 54 for the dots which are developed by the toner upon one revolution of the development roller 5*d*, i.e., the toner remaining on the development roller 5*d*, is set on the basis of the measured density value of the second patch image P2,while the exposing LUT 54 for the dots which are developed by the toner after the second revolution of the development roller 5*d*, i.e., the toner newly supplied onto the development roller 5*d*, is set on the basis of the measured density value of the third patch image P3 (Step G in FIG. 17).

If the measured density value of the third patch image P3 is less than a set value which is even lower than the set value used in Step B (Step H in FIG. 17), the amount of toner in the developing device 5 is very small, so that a determination is made that the toner is in the no toner state (Step I in FIG. 17). On the other hand, if it is determined in the steps up until now that the toner is not in the low toner state, the exposing LUT 54 used for all the dots is set on the basis of the measured density value of the third patch image P3 (Step J in FIG. 17).

Figure 18:
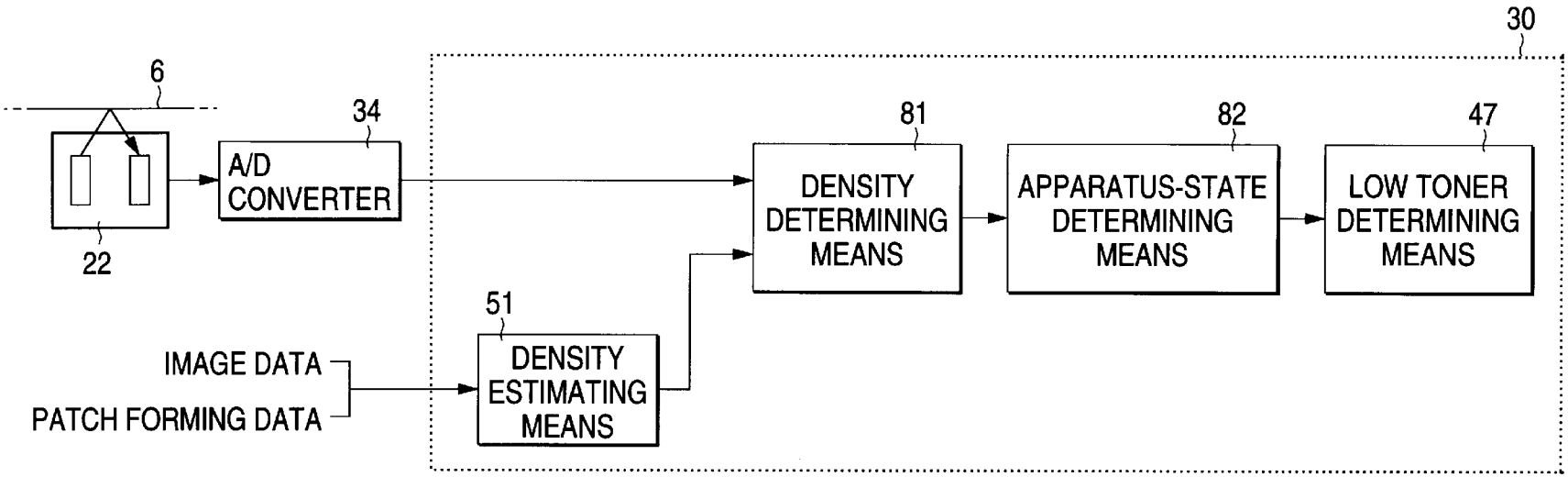
FIG. 18 is a block diagram illustrating an example of a state determining device for determining the low toner state, the no toner state, and the state of the apparatus in accordance with a signal from a patch sensor.

FIG. 18 shows an example in which the presence or absence of an abnormal state of the apparatus is determined on the basis of the low toner state, the no toner state, and the no toner state determination by means of the signal from the patch sensor 22,i.e., the means for measuring the densities of the patch images. Incorporated in the microcomputer 30 are the functions of the density estimating means 51, a density determining means 81,an apparatus state determining means 82, and the low toner determining means 47.

The density estimating means 51 estimates the densities of patch images which are formed on the intermediate transfer member 6 on the basis of the patch forming data or the image data for forming an image subject to reading by the patch sensor 22.

The density determining means 81 makes a comparison between the signal inputted thereto from the patch sensor 22 via the A/D converter, i.e., an actually measured density value, and an estimated density value inputted thereto from the density estimating means 51. If the difference between the measured density value and the estimated density value is within a predetermined range, the density determining means 81 determines that a sufficient amount of toner is present in the developing device 5, and that ordinary printing is possible. On the other hand, if the difference between the measured density value and the estimated density value is outside the predetermined range, the density determining means 81 determines that the toner in the developing device 5 has been consumed, and that printing cannot be effected with a proper density.

The result of determination by the density determining means 81 and the result of determination concerning the low toner state by the low toner determining means 47 are outputted to the apparatus state determining means 82, and are used in the determination of the state of the apparatus.

In the determination of the state of the apparatus, a determination table such as the one shown in FIG. 19 is used, and the determination table is arranged by defining the operating states of the apparatus in correspondence with four kinds of combination of the results of detection by the patch sensor 22 and the results of determination by the low toner determining means 47.

That is, if the result of measurement by the patch sensor 22 us and the result of determination by the low toner determining means 47 are "proper density" and "proper amount," respectively, the toner is determined to be in the "proper state." If the two results are "proper density" and "low toner state," respectively, the toner is determined to be in the "low toner state." If the two results are "low density" and "proper amount," respectively, it is determined that there is an "abnormality in the apparatus." Further, if the two results are "low density" and "low toner state," respectively, it is determined that the case is a "no toner state."

Of these combinations, if the result of detection by the patch sensor 22 shows "low density," and the result of determination by the low toner determining means 47 is "proper amount, " such a case shows a state in which the image is not outputted with a proper density despite the fact that sufficient toner is present in the developing device 5. In this case, therefore, it is considered that an abnormality has occurred in the developing means or the like, so that a determination is made that there is an "abnormality in the apparatus."

Namely, a number of cases are conceivable, including a case where the exposure unit 3 fails to emit light and a latent image is not formed, a case where a bias voltage is not applied to the developing device 5 and the primary transfer roller 7 due to the contact failure of an electric contact, and development and transfer are not effected, and a case where a mechanism constituting the developing device 5 cannot be rotated due to the failure of the developing device 5, making development impossible.

It should be noted that if these results of determination are outputted from the apparatus state determining means 82 to a display unit and a controller which are not shown to allow the results of determination to be displayed, and if the printer is stopped immediately in the cases of the "abnormality in the apparatus" and the "no toner state," it is possible to prevent the occurrence of a misprint.

As a method of displaying the results of determination, it suffices if the display unit is provided on the printer body, or if such as the "low toner state," the "no toner state," and the "abnormality in the apparatus" are displayed on the display screen of a personal computer connected to the printer. By providing a display appropriately in such a manner, in the case of the "abnormality in the apparatus," it is possible to prompt the user to repair the faulty portion, and in the case of the "no toner state," it is possible to accurately notify the user of the replacement of a replenishment cartridge.

A number of timings are conceivable as the timing for executing the determination shown in FIGS. 18 and 19. First of all, it is possible to cite a method in which the state of image formation is detected by constantly operating the patch sensor 22 during the normal operation of image formation after the detection of the "low toner state." Namely, this is a method in which, instead of forming patch images, the image signal being outputted is directly detected. In this method, when and after it is estimated that the no toner state is approaching, the patch sensor 22 is operated to determine the state of the apparatus, so that the deterioration over time of the patch sensor 22, particularly the deterioration of the light source, can be suppressed to a minimum.

As another method, it is possible to cite a method in which the patch sensor 22 is constantly operated during the operation of image formation irrespective of the result of determination by the low toner determining means 47. According to this method, since the state of image formation can be constantly detected, even before the "low toner state," it is possible to determine states such as the "low toner state," the "no toner state," and the "abnormality in the apparatus."

By providing such an arrangement, even in the case of the above-described method in which the number of pixels in the exposure signal is directly calculated as the amount of toner developed, the "no toner state" can be determined from the state of image formation based on the signal from the patch sensor 22,thereby making it possible to detect the no toner state accurately.

Figure 20:
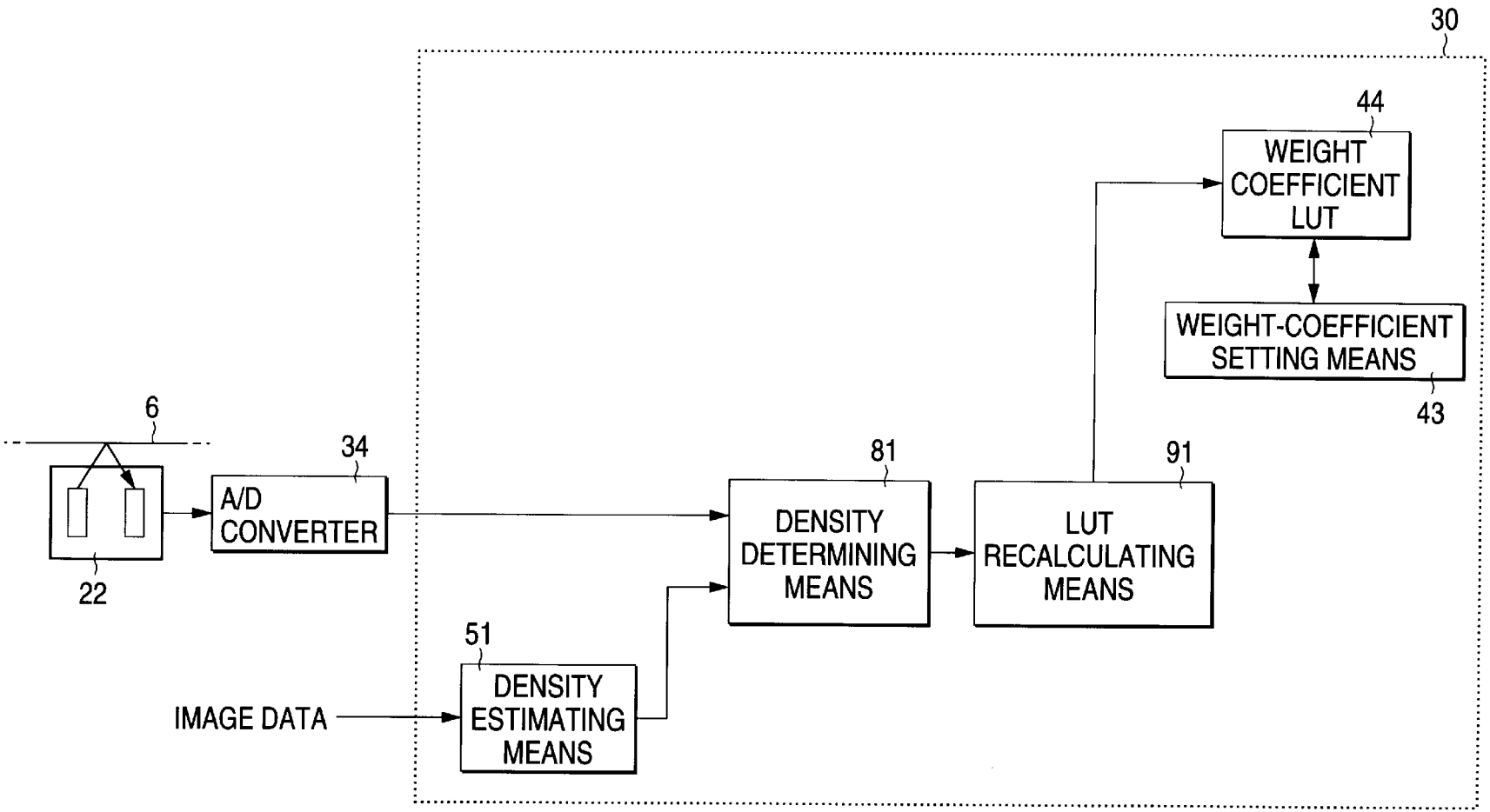
FIG. 20 is a block diagram illustrating an example of a weighting coefficient correcting means in the aforementioned apparatus.

FIG. 20 shows an example of a weighting coefficient correcting means.

This weighting coefficient correcting means is configured by incorporating in the microcomputer 30 the functions of the density estimating means 51, the density determining means 81, a LUT recalculating unit 91, the weight coefficient setting means 43, and the weighting coefficient LUT 44.

The density estimating means 51 estimates the densities of patch images which are formed on the intermediate transfer member 6 on the basis of the patch forming data or the image data for forming an image subject to reading by the patch sensor 22. The density determining means 81 calculates the kind of patch formed on the intermediate transfer member 6 and the difference in density between a measured density value and an estimated density value corresponding thereto on the basis of a digitized signal from the patch sensor 22 and an estimated density value signal from the density estimating means 51, and outputs the same to the LUT recalculating unit 91.

On the basis of the inputted density difference, the LUT recalculating unit 91 is adapted to correct the weighting coefficient LUT 44 in such a manner as to eliminate the difference between the estimated density value and the actual amount of development.

In the electrophotographic process, the amount of toner developed can change even with respect to an identical image signal due to a change over time of the environmental conditions and an electrophotographic process element. Accordingly, by correcting the weighting coefficient LUT 44 by this LUT recalculating unit 91, it is possible to enhance the accuracy in the estimation of the amount of toner developed, and reduce the error between the estimated value and the actual amount of development.

It should be noted that although, in the above-described examples, the densities of patch images transferred to the intermediate transfer member are detected, the patch sensor may be disposed at a position facing the photoconductive member, and the densities of the patch images prior to transfer which are formed on the photoconductive member may be detected. In addition, in an image forming apparatus of the type in which recording paper is wound around a transfer drum, and the toner is transferred from the photoconductive member to the recording paper on the transfer drum, the patch sensor may be disposed at a position facing the transfer drum, and patch images formed on the transfer drum may be read.

In addition, a full-color CMYK printer is used as an example of the printer in the above-described embodiment, and LUTs are prepared in correspondence with the respective colors. In addition, parameters which are adjusted on the basis of the measured density values of patch images may be parameters of the electrophotographic process, such as a charging bias, a development bias, a development roller rotating speed, and a transfer bias, and it becomes possible to print halftone images and color images with intended image quality.

In addition, it goes without saying that the determination of the low toner state in the above-described embodiment is not limited to the color toner image forming apparatus, and can be applied to a monochromatic toner image forming apparatus. Further, in an apparatus having a plurality of developing devices, even if a plurality of toners have assumed the low toner state simultaneously, it is possible to accurately detect that state. Furthermore, since the positions where patch images are formed are defined, it is possible to form patch images with clear development histories, and it is possible to enhance not only the accuracy in the detection of the no toner state but also the accuracy in the correction of the image forming conditions.

As described above, in accordance with the present invention, the arrangement provided is such that patch images are formed on the photoconductive member, the results of measurement of densities are estimated by measuring the densities of the patch images, and a comparison is made between the estimated result of each measured density and the result of the measured density which has been read, so as to determine the low toner state. Accordingly, a sensor for detecting the remaining amount of toner is made unnecessary, and it is possible to prevent the replacement of the cartridge in the state in which toner still remains, as may be experienced in the determination of the amount of toner based solely on the image forming signal. In addition, since the sensor for detecting the remaining amount of toner for each developing means is made unnecessary, it is possible to simplify the structure around the developing means of the color recording apparatus, in particular.

In addition, since the image forming conditions can be set by making use of the patch images for the determination of the low toner state, even if the developing means employs a single component toner, which has a drawback in the supply of toner to the photoconductive member, it is possible to effect stable image formation with respect to changes in the environment and the like.

In addition, since the low toner state is estimated on the basis of the image forming signal, and the remaining amount of toner is determined by using the results of measurement of densities of the patch images, by combining the detected results, it is possible to determine states such as the "proper state," the "low toner state," the "no toner state," and the "abnormality in the apparatus."

It is claimed:

1. A method of assessing a toner state of an image forming apparatus comprising a photoconductive member forming an electrostatic latent image based on pixel data of an image forming signal, a developing means for forming a toner image by attracting toner to said electrostatic latent image, and means for transferring said toner image to a recording medium, said method comprising:

providing, in a toner amount estimating step, a toner consumption estimate based on said pixel data of said image forming signal;

forming a toner testing image on said photoconductive member;

providing, in a toner amount detecting step, a toner consumption determination based on an optical density of said toner testing image prior to said transfer to said recording medium; and determining said a toner consumption state of said image forming apparatus on the basis of said toner consumption estimate and said toner consumption determination.

2. A method of assessing a toner state according to claim 1, wherein said toner consumption state is determined to be a low toner state when said toner consumption estimate surpasses a threshold.

3. A method of assessing a toner state according to claim 1, wherein said toner consumption state is determined to be a no toner state when said toner consumption determination is less than a low density threshold.

4. A method of assessing a toner state according to claim 1, wherein said toner consumption state is determined to be abnormal when said toner state is not a low toner consumption state and when said toner consumption determination is less than a low density threshold.

5. A method of assessing a toner state according to claim 1, wherein said toner amount detecting step is executed during a period of image formation.

6. A method of assessing a toner state according to claim 1, wherein said toner amount detecting step is executed when said amount of toner in said toner amount estimating step has become less than a reference value.

7. A method of assessing a toner state according to claim 1, wherein said toner consumption estimate is modified on the basis of a result of detection in said toner amount detecting step.

8. An image forming apparatus, comprising:

a photoconductive member forming an electrostatic latent image of pixels based on pixel data of an image forming signal;

means for forming a toner image by attracting toner to said electrostatic latent image, said means for forming said toner image including a development roller and defining developing means;

means for transferring said toner image to a recording medium;

means for forming a toner testing image on said photoconductive member, said toner testing image being shorter than a one revolution portion of said development roller;

means for detecting an optical density of said toner testing image prior to said transfer to said recording medium;

means, defining toner consumption amount determining means, for providing a toner consumption determination based on said optical density; and means, defining toner consumption amount estimating means, for providing a toner consumption estimate by said developing means by calculating an amount of toner consumed by each of said pixels on the basis of said image forming signal.

9. An image forming apparatus according to claim 8, further comprising:

means for determining a low toner state when said toner consumption estimate surpasses a threshold.

10. An image forming apparatus according to claim 9, further comprising:

means for determining a no toner state when said toner consumption determination is less than a low density threshold.

11. An image forming apparatus according to claim 10, further comprising:

means for determining an abnormal state when a result of determination by said low toner determining means is not said low toner state, and when it is determined by said no toner determining means that said amount of toner has reached said no toner state.

12. An image forming apparatus according to claim 8, wherein said toner consumption amount determining means operates during a period of image formation.

13. An image forming apparatus according to claim 8, wherein said toner consumption amount determining means operates when said low toner determining means determines that said amount of toner has reached said low toner state.

14. An image forming apparatus according to claim 8, further comprising:

means for changing said estimated amount estimated by said toner consumption amount estimating means on the basis of a result of detection by said toner consumption amount determining means.

15. A method of forming an image using an image forming apparatus, said method comprising:

generating a light beam based on an image forming signal;

forming, on a photoconductive member, an electrostatic latent image upon receipt of said light beam;

attracting toner to said electrostatic latent image via a development roller to form a toner image;

transferring said toner image to a recording medium;

forming a toner testing image on said photoconductive member;

measuring an optical density of said toner testing image prior to said transferring step;

detecting, in a toner amount detecting step, an amount of toner consumed by said developing means on the basis of said optical density of said toner testing image and pixel data of an image forming signal to provide a toner consumption determination;

wherein said toner amount detecting step further comprises:

estimating, in an estimating step, said optical density, and comparing in a comparing step, said estimated optical density and said detected optical density.

16. A method of forming an image according to claim 15, further comprising:

setting a condition for image formation on the basis of said optical density.

17. A method of forming an image according to claim 16, wherein estimation is made in said estimating step by forming said toner testing image by using a different toner.

18. A method of forming an image according to claim 17, wherein said toner testing image comprises first and second toner testing images formed at a position corresponding to a one revolution portion of said development roller, and said estimating step is executed on the basis of said optical density of said second toner testing image.

19. A method of forming an image according to claim 15, wherein:

said toner testing image comprises first, second, and third toner testing images;

said first and said second toner testing images are formed at a position short of a one revolution portion of said development roller;

said third toner testing image is formed at a position spaced from said first toner testing image and corresponding to said one revolution portion; and said low toner state is determined by comparing respective optical densities of said second and third toner testing images.

20. An image forming apparatus, comprising:

a photoconductive member forming an electrostatic latent image of pixels based on pixel data of an image forming signal;

means for forming a toner image by attracting toner to said electrostatic latent image, said means for forming said toner image including a development roller and defining developing means;

means for transferring said toner image to a recording medium;

exposure controlling means for forming a toner testing image on said photoconductive member, said toner testing image being shorter than a one revolution portion of said development roller;

optical density detecting means for detecting an optical density of said toner testing image prior to said transfer to said recording medium;

controlling means for determining a low toner state of said developing means on the basis of said optical density;

wherein said controlling means estimates said optical density of said toner testing image based on image data of said toner testing image and compares said estimated optical density and said optical density detected by said optical density detecting means so as to determine said low toner state.

21. An image forming apparatus according to claim 20, wherein said controlling means sets a condition for image formation on the basis of a signal from said optical density detecting means.

22. An image forming apparatus according to claim 20, wherein said developing means develops a latent image of said toner testing image by a toner of a different color, and compares a measured value measured by said optical density detecting means and an estimated value based on a result of measurement of said density of said toner testing image of said different color.

23. An image forming apparatus according to claim 20, wherein said exposure controlling means forms first and second toner testing images at a position corresponding to a one revolution portion of said development roller and said controlling means determines said low toner state on the basis of said second toner testing image.

24. An image forming apparatus according to claim 20, wherein said exposure controlling means forms first and second toner testing images at a position short of a one revolution portion of said development roller as well as a third toner testing image at a position spaced apart from said first toner testing image and corresponding to the one revolution portion, and said controlling means determines said low toner state by comparing optical densities of said second and third toner testing images.

25. A method of assessing a toner state of an image forming apparatus comprising a photoconductive member forming an electrostatic latent image based on pixel data of an image forming signal, a developing unit for forming a toner image by attracting toner to said electrostatic latent image, and a transfer unit for transferring said toner image to a recording medium, said method comprising:

providing, in a toner amount estimating step, a toner consumption estimate based on said pixel data of said image forming signal;

forming a toner testing image on said photoconductive member;

providing, in a toner amount detecting step, a toner consumption determination based on an optical density of said toner testing image prior to said transfer to said recording medium; and determining a toner consumption state of said image forming apparatus on the basis of said toner consumption estimate and said toner consumption determination.

26. An image forming apparatus, comprising:

a photoconductive member forming an electrostatic latent image of pixels based on pixel data of an image forming signal;

a developer for forming a toner image by attracting toner to said electrostatic latent image, said developer including a development roller;

a transfer unit for transferring said toner image to a recording medium;

an image formation unit for forming a toner testing image on said photoconductive member, said toner testing image being shorter than a one revolution portion of said development roller;

a detector for detecting an optical density of said toner testing image prior to said transfer to said recording medium;

a toner consumption determination unit for providing a toner consumption determination based on said optical density; and an estimator for providing a toner consumption estimate by said developer by calculating an amount of toner consumed by each of said pixels on the basis of said image forming signal.

27. An image forming apparatus, comprising:

a photoconductive member forming an electrostatic latent image of pixels based on pixel data of an image forming signal;

a developing unit for forming a toner image by attracting toner to said electrostatic latent image, said developing unit including a development roller and defining developing means;

a transfer unit for transferring said toner image to a recording medium;

exposure controller for forming a toner testing image on said photoconductive member, said toner testing image being shorter than a one revolution portion of said development roller;

optical detector for detecting an optical density of said toner testing image prior to said transfer to said recording medium;

controller for determining a low toner state of said developing unit on the basis of said optical density;

wherein said controller estimates said optical density of said toner testing image based on image data of said toner testing image and compares said estimated optical density and said optical density detected by said optical density detector so as to determine said low toner state.

* * * * *